US007592112B2

(12) United States Patent
Shiino et al.

(10) Patent No.: US 7,592,112 B2
(45) Date of Patent: Sep. 22, 2009

(54) ELECTROPHOTOGRAPHIC PHOTORECEPTOR, PROCESS CARTRIDGE AND ELECTROPHOTOGRAPHIC APPARATUS

(75) Inventors: Shigeaki Shiino, Minamiashigara (JP); Makoto Takemoto, Minamiashigara (JP); Makoto Kusayanagi, Minamiashigara (JP); Koichi Yasaku, Minamiashigara (JP); Hirokazu Sakashita, Minamiashigara (JP); Makoto Nishimura, Minamiashigara (JP); Yu Qi, Oakville (CA); Nan-Xing Hu, Oakville (CA); Ah-Mee Hor, Mississauga (CA)

(73) Assignees: Fuji Xerox Co., Ltd., Tokyo (JP); Xerox Corporation, Norwalk, CT (US)

( * ) Notice: Subject to any disclaimer, the term of this patent is extended or adjusted under 35 U.S.C. 154(b) by 312 days.

(21) Appl. No.: 11/083,027

(22) Filed: Mar. 18, 2005

(65) Prior Publication Data

US 2006/0014090 A1 Jan. 19, 2006

(30) Foreign Application Priority Data

Jul. 16, 2004 (JP) ..... 2004-210751

(51) Int. Cl.
*G03G 5/14* (2006.01)

(52) U.S. Cl. ..... 430/59.1; 430/60; 430/65; 399/159

(58) Field of Classification Search ..... 430/59.1, 430/60, 65; 399/159
See application file for complete search history.

(56) References Cited

U.S. PATENT DOCUMENTS

| | | | | |
|---|---|---|---|---|
| 4,264,695 | A | 4/1981 | Kozima et al. | |
| 4,265,990 | A | 5/1981 | Stolka et al. | |
| 4,298,697 | A | 11/1981 | Baczek et al. | |
| 4,338,390 | A | 7/1982 | Lu | |
| 4,560,635 | A | 12/1985 | Hoffend et al. | |
| 4,778,671 | A | 10/1988 | Wusirika | |
| 4,792,507 | A | 12/1988 | Yoshihara et al. | |
| 5,008,706 | A | 4/1991 | Ohmori et al. | |
| 5,102,757 | A | 4/1992 | Akasaki et al. | |
| 5,363,176 | A | 11/1994 | Ishihara et al. | |
| 5,430,526 | A | 7/1995 | Ohkubo et al. | |
| 5,446,011 | A | 8/1995 | Hayakawa et al. | |
| 5,486,440 | A | 1/1996 | Kashizaki et al. | |
| 5,795,690 | A * | 8/1998 | Takegawa et al. | 430/58.25 |
| 5,891,594 | A | 4/1999 | Yuh et al. | |
| 5,958,638 | A | 9/1999 | Katayama et al. | |
| 5,972,550 | A | 10/1999 | Tamura et al. | |
| 6,137,976 | A | 10/2000 | Itaya et al. | |
| 6,183,869 | B1 | 2/2001 | Okuda et al. | |
| 6,190,811 | B1 | 2/2001 | Tanaka et al. | |
| 6,277,535 | B1 | 8/2001 | Liu et al. | |
| 6,284,421 | B1 | 9/2001 | Matsuzaki et al. | |
| 6,453,139 | B2 | 9/2002 | Sesame et al. | |
| 6,455,222 | B1 | 9/2002 | Fukino et al. | |
| 6,623,655 | B1 | 9/2003 | Kappel et al. | |
| 6,773,857 | B2 | 8/2004 | Nakamura et al. | |
| 6,795,690 | B2 | 9/2004 | Weissman et al. | |
| 6,921,618 | B2 | 7/2005 | Hongo et al. | |
| 6,924,076 | B2 | 8/2005 | Saiki et al. | |
| 6,946,226 | B2 | 9/2005 | Wu et al. | |
| 7,153,574 | B2 | 12/2006 | Qi et al. | |
| 2002/0025179 | A1 | 2/2002 | Toyohara et al. | |
| 2003/0118927 | A1 | 6/2003 | Nakamura et al. | |
| 2004/0161684 | A1 | 8/2004 | Wu et al. | |
| 2005/0042533 | A1 | 2/2005 | Wu et al. | |
| 2005/0207788 | A1 | 9/2005 | Bandou et al. | |
| 2006/0013615 | A1 | 1/2006 | Nukada et al. | |
| 2006/0013616 | A1 | 1/2006 | Nukada et al. | |
| 2006/0014090 | A1 | 1/2006 | Shiino et al. | |
| 2006/0014091 | A1 | 1/2006 | Nukada et al. | |
| 2006/0014092 | A1 | 1/2006 | Nukada et al. | |
| 2006/0029872 | A1 * | 2/2006 | Qi et al. | 430/58.8 |

FOREIGN PATENT DOCUMENTS

| | | | |
|---|---|---|---|
| CN | 1105128 | | 7/1995 |
| CN | 1207635 | C | 3/2003 |
| CN | 1403879 | A | 3/2003 |
| EP | 810481 | A2 * | 12/1997 |
| EP | 1286225 | | 11/2005 |
| JP | A 60-218655 | | 11/1985 |
| JP | A 61-80158 | | 4/1986 |
| JP | B2 61-35551 | | 8/1986 |
| JP | A 61-204640 | | 9/1986 |
| JP | A 63-142362 | | 6/1988 |
| JP | A 7-175249 | | 7/1995 |
| JP | A 8-044097 | | 2/1996 |
| JP | A 9-197701 | | 7/1997 |
| JP | 9-218592 | | 8/1997 |
| JP | A 2003-241511 | | 8/2003 |
| JP | A 2004-126069 | | 4/2004 |

OTHER PUBLICATIONS

Varcum 29159 Data Sheet, Durez Corp., (Jul. 13, 2005).*
Grant & Hackh's Chemical Dictionary, Fifth edition, p. 268, 1987.

* cited by examiner

*Primary Examiner*—Christopher RoDee
(74) *Attorney, Agent, or Firm*—Oliff & Berridge, PLC

(57) ABSTRACT

A multilayer electrophotographic photoreceptor, comprising an electroconductive substrate, and at least an interlayer and a charge-generating layer formed on the substrate, wherein the interlayer comprises fine metal oxide particles and the interlayer and the charge-generating layer comprise anthraquinone derivative(s), and wherein the interlayer has a volume resistivity in a range of $1.0\times10^{8}$ Ω·cm to $1.0\times10^{13}$ Ω·cm when an electric field of $10^{6}$ V/m is applied thereto at 28° C. and 85% relative humidity. A process cartridge and an image forming apparatus using the multilayer electrophotographic photoreceptor are also provided.

14 Claims, 5 Drawing Sheets

ELECTROPHOTOGRAPHIC PHOTORECEPTOR, PROCESS CARTRIDGE AND ELECTROPHOTOGRAPHIC APPARATUS

CROSS-REFERENCE TO RELATED APPLICATION

This application claims priority under 35 USC 119 from Japanese Patent Application No. 2004-210751, the disclosure of which is incorporated by reference herein.

BACKGROUND OF THE INVENTION

1. Field of the Invention

The present invention relates to an electrophotographic photoreceptor used in a copier, a printer, etc., and a process cartridge and an electrophotographic apparatus using the same.

2. Description of the Related Art

As photoconductive materials in an electrophotographic photoreceptor, a variety of inorganic and organic materials have been known. Organic photoreceptors employing photoconductive organic materials have come to be mainly used in the art for their advantages of satisfactory film forming properties, flexibility, low cost and the like.

As electrophotographic photoreceptors comprising an organic photosensitive layer on an electroconductive substrate can be mentioned: multilayer photoreceptors in which the photosensitive layer is function-separated into a charge-generating layer and a charge-transporting layer; and single-layer photoreceptors in which charge-generating and charge-transporting functions are included in a single layer. Among these multilayer electrophotographic photoreceptors are generally used in view of easier control of the characteristics of the photoreceptor by the function-separation.

Further, in the multilayer photoreceptors, interposing an interlayer consisting of various materials between the electroconductive substrate and the photosensitive layer of the photoreceptor has been tried, in order to reduce drawbacks due to the repetitive use of the charging-exposure processes, such as reduction of charging, increase in dark decay, increase in residual potential and image quality defects.

This interlayer is provided for the purpose of preventing unnecessary charge injection from the electroconductive substrate; maintaining adequate reception of the charges generated in the charge-generating layer at exposure; and improving adhesiveness between the photosensitive layer and the electroconductive substrate.

Meanwhile, when charge-generating materials are used for a photosensitive material for a semiconductor laser, it is necessary to firstly extend the photosensitive wavelengths into the long-wavelength region, and then improve the electrical properties and durability of the formed photoreceptor. Further, phthalocyanine compounds, etc., exhibiting sensitivity in the wavelength ranges of semiconductor lasers, have attracted attention.

However, depending on the composition of the charge-generating layer, sometimes a charge carrier which should input to the substrate side, is re-combined with charge carrier of the opposite polarity in the charge-generating layer, or accumulates at the boundary of the interlayer and the charge-generating layer to form a space charge barrier, thereby reducing the charging potential with repetitive use and increasing the residual potential. As a means for preventing such drawbacks, it has been suggested that an electron-donating material be contained in the interlayer. For example, the following have been tried; providing a barrier layer comprising a non-hydrophilic peptide polymer and an electron-donating material or an electron-accepting material (for example, refer to JP-B No. 61-35551); providing an interlayer comprising an electron-donating material (for example, refer to JP-A No. 60-218655); providing an interlayer comprising a hydrazone compound (for example, refer to JP-A No. 61-80158); or providing an interlayer comprising a charge-transporting material such as imidazole, pyrazoline, thiazole, oxadiazole, oxazole, hydrazone, ketazine, azine, carbazole, polyvinylcarbazole, etc. (for example, refer to JP-A No. 61-204640).

However, accompanying the increases in speed and durability of copiers in recent years, there have been further demands for an electrophotographic photoreceptor with higher sensitivity in photo-responsiveness and higher durability.

The invention is to provide an excellent electrophotographic photoreceptor which allows charges to be easily moved between an interlayer and a charge-transporting layer, and has high sensitivity and low residual potential. Further, the invention provides an electrophotographic apparatus and a process cartridge, wherein even with prolonged repetitive use, low residual potential is not deteriorated while maintaining high sensitivity, thereby obtaining suitable images having no decrease in image concentration and no smudging.

SUMMARY OF THE INVENTION

Accordingly, a first aspect of the present invention provides a multilayer electrophotographic photoreceptor comprising an electroconductive substrate, and at least an interlayer and a charge-generating layer formed on the substrate, wherein the interlayer comprises fine metal oxide particles, and the interlayer and the charge-generating layer comprise anthraquinone derivative(s), and wherein the interlayer has a volume resistivity in a range of $1.0\times10^{8}$ Ω·cm to $1.0\times10^{13}$ Ω·cm when electric field of $10^{6}$ V/m is applied thereto at 28° C. and 85% relative humidity.

A second aspect of the invention provides a process cartridge comprising an electrophotographic photoreceptor; and at least one of a charging unit, a development unit, a cleaning unit and an erase unit, wherein the electrophotographic photoreceptor is a multilayer electrophotographic photoreceptor comprising an electroconductive substrate, and at least an interlayer and a charge-generating layer formed on the substrate; wherein the interlayer comprises fine metal oxide particles and the interlayer and the charge-generating layer comprise anthraquinone derivative(s); wherein the interlayer has a volume resistivity in a range of $1.0\times10^{8}$ Ω·cm to $1.0\times10^{13}$ Ω·cm when electric field of $10^{6}$ V/m is applied thereto at 28° C. and 85% relative humidity; and wherein the process cartridge can be attached to and removed from a main body of an electrophotographic apparatus.

Lastly, a third aspect of the invention provides an electrophotographic apparatus comprising: an electrophotographic photoreceptor; and at least one of a charging unit, a development unit, a cleaning unit, an erasing unit, a transfer unit and an image-fixing unit; wherein the electrophotographic photoreceptor is a multilayer electrophotographic photoreceptor comprising an electroconductive substrate, and at least an interlayer and a charge-generating layer formed on the substrate; wherein the interlayer comprises fine metal oxide particles and the interlayer and the charge-generating layer comprise anthraquinone derivative(s); wherein the interlayer has a volume resistivity in a range of $1.0\times10^{8}$ Ω·cm to $1.0\times10^{13}$ Ω·cm when electric field of $10^{6}$ V/m is applied thereto at 28° C. and 85% relative humidity.

BRIEF DESCRIPTION OF THE DRAWINGS

Preferred embodiments of the present invention will be described in detail based on the following figures, wherein.

DETAILED DESCRIPTION OF THE INVENTION

Figure 1:
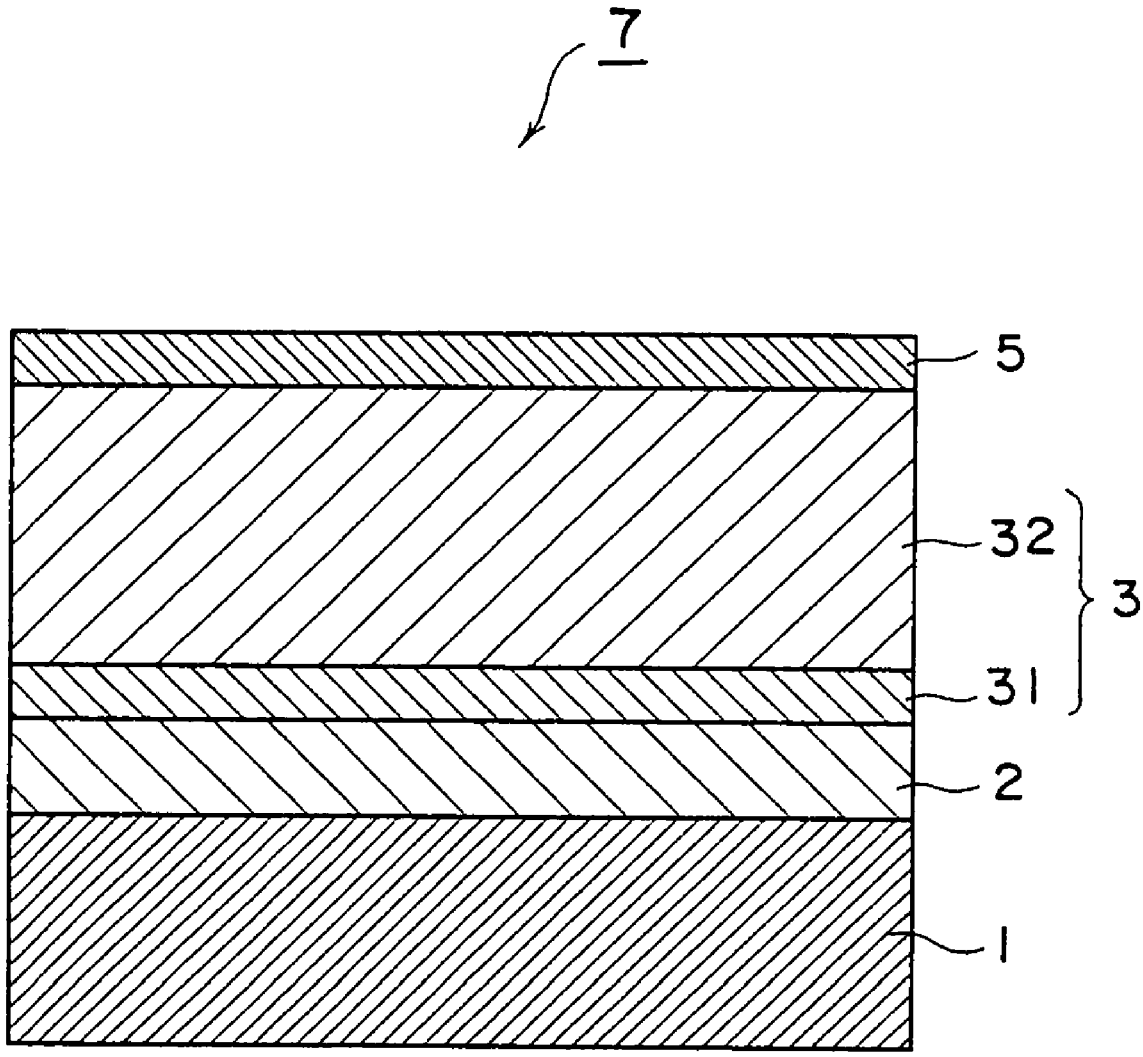
FIG. 1 is a schematic sectional view illustrating an example of an electrophotographic photoreceptor of the present invention.

Electrophotography is a technology wherein the surface of an electrophotographic photoreceptor to be an image carrier is uniformly charged; a latent image is formed by an exposure unit; the latent image is developed into a toner image; and then an image is formed by transferring the toner image to a receiving member.

For the electrophotographic photoreceptor which is charged in the charging process, the irradiated light is absorbed by the charge-generating material in the charge-generating layer during the continuous exposure process, and the charge-generating material which has been excited to a higher energy level, remains in a state where a positive charge and a negative charge are separated within the molecule.

In an electrophotographic process which utilizes negative charging of the electrophotographic photoreceptor, a charge-transporting layer comprises a hole-transporting material, and the positive charges generated in a charge-generating layer in the exposure process is electrically conducted by the charge-transporting layer, reaching the surface of the electrophotographic photoreceptor to eliminate the negative charges on the charged surface.

As such, the charged regions on the surface of the electrophotographic photoreceptor and the regions with the negative charges eliminated on the surface by the exposure form a latent image.

Meanwhile, negative charges generated in the charge-generating layer by exposure are transferred to the electroconductive substrate via the interlayer.

Since the electrophotographic photoreceptor has high speed and high efficiency in photo-responsiveness, in addition to, for example, high efficiency in charge generation and high charge transportability of the charge-transporting layer, it is also necessary to rapidly transport the negative charges generated in the charge-generating layer to the electroconductive substrate side.

That is, by the movement of the negative charges to the substrate side, the electrical Coulomb force which interrupts the movement of the positive charges is removed and the positive charges efficiently move to the charge-transporting layer. Further, the positive charges and the negative charges no longer dissipate by their recombination, thus the apparent efficiency in the charge generation is improved.

Under theses circumstances, the inventors made extensive studies and discovered that the photo-responsiveness of an electrophotographic photoreceptor can be drastically improved by controlling the resistance value of the interlayer in order to rapidly transport negative charges generated in a charge-generating layer to the substrate, by having an anthraquinone derivative in both the interlayer and the charge-generating layer. Such improvement in the photo-responsiveness shows a synergy effect compared with the effect when an anthraquinone derivative is added to each of the layers singly.

It is assumed that the reasons for obtaining good photo-responsiveness in the present invention is that by having an anthraquinone derivative in both of the interlayer and the charge-generating layer allows smooth transferring of the charges not only within the films of both layers, but also at the interface. It is believed that the further increase in photo-responsiveness which is observed by using the same kind of anthraquinone derivative in each layer supports such an assumed mechanism.

In the following, the present invention will be clarified in detail by a preferred embodiment thereof, with reference to the accompanying drawings. In the drawings, the same or equivalent parts will be represented by the same numbers and repetition of the explanation will not be made.

(Electrophotographic Photoreceptor)

FIG. 1 is a schematic sectional view illustrating an example of an electrophotographic photoreceptor of the invention. The electrophotographic photoreceptor 7 has a multilayered structure comprising an electroconductive substrate 1, and, formed on the substrate in the following order, an interlayer 2, a photosensitive layer 3 consisting of a charge-generating layer 31 and a charge-transporting layer 32, and a protective layer 5.

The conductive substrate 1 is constituted of a metal drum such as of aluminum, copper, iron, stainless steel, zinc or nickel; a base material such as a sheet of paper, plastics or glass evaporated thereon with a metal such as aluminum, copper, gold, silver, platinum, palladium, titanium, nickel-chromium, stainless steel, or indium or a conductive metal compound such as indium oxide or tin oxide; an aforementioned base material laminated with a metal foil or an aforementioned base material rendered electroconductive by coating with carbon black, indium oxide, tin oxide, antimony oxide powder, metal powder, or copper iodide dispersed in a binder resin.

The conductive substrate 1 is not limited to a drum shape but can also be a sheet shape or a plate shape. In case the conductive substrate 1 is formed by a metal pipe, the surface thereof may be untreated, or may be subjected in advance to a suitable treatment such as mirror grinding, etching, anodizing, rough grinding, centerless grinding, sand blasting or wet honing.

The interlayer 2 is positioned between the conductive substrate and the sensitive layer in order to prevent a charge leakage from the conductive substrate to the sensitive layer and to adhere the sensitive layer to the conductive substrate integrally.

The interlayer 2 contains an anthraquinone derivative. More preferably, the anthraquinone derivative is an alizarin derivative.

Thus, the electrophotographic photoreceptor becomes more sensitive, and maintains highly sensitivity even with repetitive use.

Particularly, the anthraquinone derivatives represented by the following Formulae (A-1) to (A-8) are suitable.

(A-1)

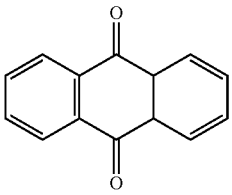

Anthraquinone (A-2)

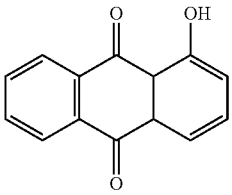

1-Hydroxyanthraquinone (A-3)

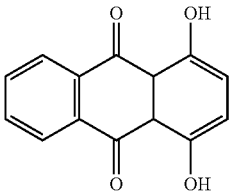

Quinizarine (A-4)

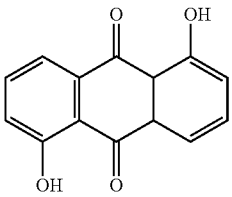

Anthrarufine (A-5)

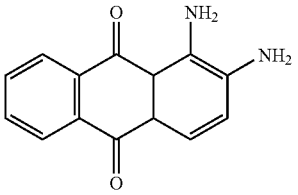

1,2-Diaminoanthraquinone (A-6)

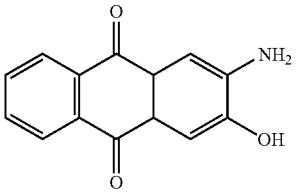

2-Amino-3-hydroxyanthraquinone

-continued (A-7)

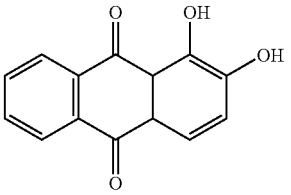

Alizarine (A-8)

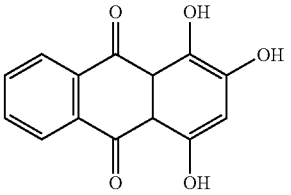

Purpurine

The content of the anthraquinone derivatives can be arbitrarily set as long as the photoreceptor has the desired properties, but is preferably 0.1 to 3.0% by weight, and more preferably 0.5 to 1.0% by weight relative to the interlayer 2.

When the content of the anthraquinone derivative is 0.1% by weight or less, the interlayer 2 may not be obtained having sufficient acceptor property to contribute to improvement in storing charges, thereby resulting in deterioration in the maintenance in the residual potential, such as an increase with repetitive use. Meanwhile, when the content of the anthraquinone derivative is 3.0% by weight or more, it may easily cause the agglomeration of the metal oxides one with another. Thus, when forming the interlayer 2, the metal oxides in the interlayer 2 may not form a good electroconductive path, and not only will the maintenance in the residual potential may be deteriorated, as such increasing with repetitive use, but also image quality defects such as black spots, etc.

It is necessary for the interlayer 2 to contain fine metal oxide particles in order for a volume resistivity to be in a range of $1.0\times10^{8}$ Ω·cm to $1.0\times10^{13}$ Ω·cm when an electric field of $10^{6}$ V/m is applied thereto at 28° C. and 85% RH humidity.

By controlling the volume resistivity of the interlayer 2 to satisfy the above conditions, both leakage prevention properties and electrical properties can be obtained in high level.

In the interlayer 2, by appropriately selecting the kinds and the blending amounts of the fine metal oxide particles and the binder resin, and further by increasing the dispersibility of the fine metal oxide particles in the binder resin, the volume resistivity can be controlled to satisfy the above conditions.

The fine metal oxide particles used in the invention need a volume resistivity in a range of about $10^{2}$ to $10^{11}$ Ω·cm. That is, in order to attain the leakage tolerance of the interlayer 2, it is necessary to obtain the appropriate resistance. Among them, it is preferable to use fine metal oxide particles such as tin oxide, titanium oxide and zinc oxide, which have the above resistance value, and particularly preferably zinc oxide. Further, when the resistance value of the fine metal oxide particles is lower than the lower limit in the above range, sufficient leakage tolerance may not be obtained, while when it is higher than the upper limit in the above range, an increase in residual potential may occur.

Also metal oxide fine particles which are a mixture of two or more kinds, which are different for example in the surface treatment or in the particle size, may be employed.

In addition, it is preferable to use fine metal oxide particles having a specific surface area of 10 $m^2/g$ or more. In the case of having a specific surface area of 10 $m^2/g$ or less, there may be the drawbacks that easily the charging ability may be lowered and it may be difficult to obtain good electrophotographic characteristics.

Further, the fine metal oxide particles can be subject to a surface treatment. The surface treating agent can be selected from known materials including a silane coupling agent, a titanate-based coupling agent, an aluminum-based coupling agent and a surfactant, as long as it gives the desired characteristic. Particularly, a silane coupling agent is preferably used since it imparts good electrophotographic characteristic. Further, a silane coupling agent having an amino group is preferably used since it imparts good blocking ability to the interlayer 2.

Any silane coupling agent having an amino group capable of providing the electrophotographic photoreceptor with the desired characteristics can be used, and specific examples include γ-aminopropyltriethoxysilane, N-β-(aminoethyl)-γ-aminopropyl trimethoxysilane, N-β-(aminoethyl)-γ-aminopropylmethyl methoxysilane and N,N-bis(β-hydroxyethyl)-γ-aminopropyl triethoxysilane, but these examples are not restrictive.

The silane coupling agent may also be employed in a mixture of two or more kinds. Examples of silane coupling agents that can be used in combination with the silane coupling agent having an amino group include vinyltrimethoxysilane, γ-methacryloxypropyl-tris(β-methoxyethoxy)silane, β-(3,4-epoxycyclohexyl)ethyl trimetoxysilane, γ-glycidoxypropyl trimethoxysilane, vinyltriacetoxysilane, γ-mercaptopropyltrimethoxysilane, γ-aminopropyltriethoxysilane, N-β-(aminoethyl)-γ-aminopropyl trimethoxysilane, N-β-(aminoethyl)-γ-aminopropylmethyl methoxysilane, N,N-bis(β-hydroxyethyl)-γ-aminopropyl triethoxysilane, and γ-chloropropyltrimethoxysilane, but these examples are not restrictive.

Surface treatment may be executed in any known method, and can be executed by a dry method or a wet method.

In case of a surface treatment with a dry method, a uniform surface treatment can be achieved by maintaining the metal oxide fine particles in agitation with a mixer or the like of a high shearing force and adding the silane coupling agent dropwise, either directly or in a state dissolved in an organic solvent, spraying it together with dry air or nitrogen gas. The addition or spraying is preferably executed below the boiling point of the solvent, as the spraying at or above the boiling point of the solvent may cause evaporation of the solvent before a uniform agitation is attained, thus resulting in a localized solidification of the silane coupling agent and hindering a uniform treatment. After the addition or spraying, a baking can be carried out at or above 100° C. The baking may be executed within an arbitrary range of temperature and time capable of providing the desired electrophotographic characteristics.

A uniform treatment in the wet method can be achieved by agitating the metal oxide fine particles in a solvent, dispersing them utilizing an ultrasonic wave, a sand mill, an attriter or a ball mill, then adding a solution of the silane coupling agent in an organic solvent, executing agitation or dispersion, and eliminating the solvent. The solvent can be eliminated by filtration or distillation. After the removal of the solvent, a baking can be carried out at or above 100° C. The baking may be executed within an arbitrary range of temperature and time capable of providing desired electrophotographic characteristics. In the wet method, it is also possible to eliminate the moisture contained in the metal oxide fine particles prior to the addition of the surface treating agent, for example by heating under agitation in a solvent to be used for the surface treatment or by an azeotropic elimination with a solvent.

The amount of the silane coupling agent used relative to the fine metal oxide particles in the interlayer 2 can be arbitrarily set as long as the photoreceptor has the desired properties.

Examples of the binder resin contained in the interlayer 2 include a polyethylene resin, an acrylic resin, a methacrylic resin, a polyamide resin, a vinyl chloride resin, a vinyl acetate resin, a phenol resin, a urethane resin, a polyimide resin, a vinylidene chloride resin, a polyvinyl acetal resin, a polyvinyl alcohol resin, a water-soluble polyester resin, an alcohol-soluble nylon resin, a nitrocellulose, a polyacrylic acid and, polyacrylamide and copolymers thereof, or a hardened organometallic compound such as a zirconium alkoxide compound, a titanium alkoxide compound and a silane coupling agent. These can used alone or in a mixture of two or more.

Further, a layer formed by using materials that transport only charges having the same polarity as the charged polarity is usable as the interlayer 2. Among them, the interlayer 2 formed by using at least a zirconium alkoxide compound is suitable since the property of preventing charge leakage from the electroconductive support to the photosensitive layer is enhanced, and the residual potential is restricted to a low value, and further the change in characteristics that accompany changes in the environment are small.

The interlayer 2 is preferably formed by dip coating in a coating solution obtained by dissolving or dispersing a material as described above in an appropriate solvent, but also may be formed by conventional methods such as blade coating, wire bar coating, spray coating, bead coating, air knife coating, curtain coating, ring coating, etc. Further, the interlayer 2 may be multilayered.

Fine organic or inorganic semi-electroconductive particles may be contained in the interlayer 2, and a ball mill, a roll mill, a sand mill, an attritor, ultrasound, etc. can be applied as the mixing or dispersing process. The mixing/dispersion is conducted in an organic solvent, wherein as the organic solvent, any one is usable as long as it dissolves the organometallic compound or resin, and does not cause gelling or agglomeration when mixing/dispersing the fine organic or inorganic semi-electroconductive particles. Examples of the conventional organic solvent include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, toluene, etc. which can be used alone or in a mixture of two or more.

The charge-generating layer 31 is formed by using at least the coating solution comprising an anthraquinone derivative, a charge-generating material and a binder resin.

The anthraquinone derivative which is added to a charge-generating layer 31, is preferably an alizarin derivative, and more preferably a compound having the same composition as in the anthraquinone derivative contained in the interlayer 2.

Thus, the electrophotographic photoreceptor become more sensitive and maintains high sensitivity even with repetitive use, thus it is particularly preferable.

In particular, the anthraquinone derivatives represented by the following Formulae (B-1) to (B-8) are particularly suitable.

(B-1)

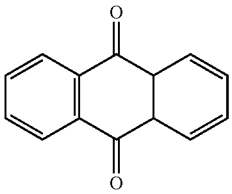

Anthraquinone (B-2)

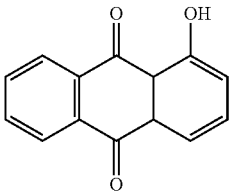

1-Hydroxyanthraquinone (B-3)

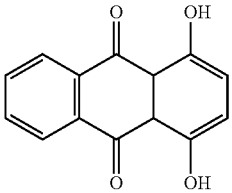

Quinizarine (B-4)

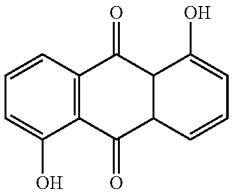

Anthrarufine (B-5)

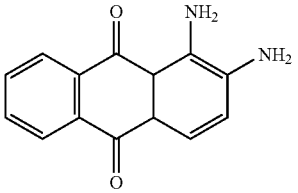

1,2-Diaminoanthraquinone (B-6)

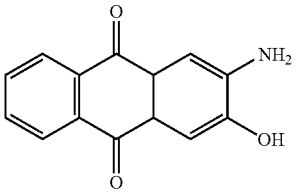

2-Amino-3-hydroxyanthraquinone

-continued (B-7)

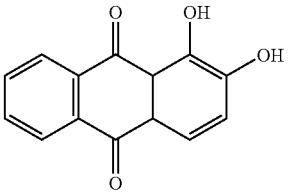

Alizarine (B-8)

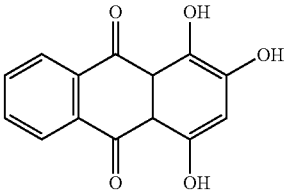

Purpurine

The amount of the anthraquinone derivative is arbitrarily set, as long as it gives the desired characteristic, but preferably is in a range of 0.01 and 2.0% by weight, and more preferably 0.1 and 1.0% by weight.

When the content of the anthraquinone derivative is 0.01% by mass or less, the effect as an acceptor may not be exhibited, thereby a sufficient decrease in potential there may not be caused. Further, when the content of the anthraquinone derivative is 2.0% by weight or more, there is a tendency to increase fogging.

Examples of the charge-generating material contained in the charge-generating layer 31 include the conventional charge-generating materials such as an azo pigment, a disazo pigment, a quinone pigment, a quinocyanine pigment, a perylene pigment, an indigo pigment, a bisbenzoimidazole pigment, a phthalocyanine pigment, a quinacridone pigment, a pyrilium salt, an azulenium salt and trigonal selenium.

Examples of the binder resin contained in the charge-generating layer 31 include polycarbonate, polyacrylate, polystyrene, poly(meth)acrylic acid, poly(meth)acrylic ester, a styrene-methacrylic ester copolymer, polyester, a styrene-acrylonitrile copolymer, polysulfone, polyvinylacetate, polyacrylonitrile, polyvinylbutyral, polyvinylpyrrolidone, methylcellulose, hydroxymethylcellulose, cellulose esters, etc.

In addition, as the solvent in the coating solution for forming a charge-generating layer, a highly volatile solvent with its vapor density higher than air is suitably used. For example, n-butylamine, diethylamine, ethylene diamine, isopropanol amine, triethanol amine, N,N-dimethylformamide, acetone, methyl ethyl ketone, cyclohexanone, benzene, 4-methoxy-4-methylpentanone, dimethoxymethane, dimethoxyethane, 2,4-pentadione, anisole, methyl 3-oxobutanoate, monochlorobenzene, toluene, xylene, chloroform, 1,2-dichloroethane, dichloromethane, tetrahydrofuran, dioxane, methanol, ethanol, isopropanol, 1-butanol, ethyl acetate, butyl acetate, dimethyl sulfoxide, methyl cellosolve, ethyl cellosolve, methyl cellosolve acetate, etc., or other known solvents. These can be used alone or in a mixture of two or more.

A charge-transporting layer 32 is formed by using a coating solution comprising at least a charge-transporting material and a binder resin.

A charge transport material contained in a charge transport layer 32 may be any known charge transport material. Examples include: hole transport materials, for example an oxadiazole derivative such as 2,5-bis(p-diethylaminophenyl)-1,3,4-oxadiazole, a pyrazoline derivative such as 1,3,5-triphenyl-pyrazoline or 1-[pyridyl-(2)]-3-(p-diethylaminostyryl)-5-(p-diethylaminostyryl)pyrazoline, an aromatic tertiary amino compound such as triphenylamine, tri(p-methyl)phenylamine, N,N'-bis(3,4-dimethylphenyl)biphenyl-4-amine, dibenzylaniline, or 9,9-dimethyl-N,N'-di(p-tolyl) fluorenone-2-amine, an aromatic tertiary diamino compound such as N,N'-diphenyl-N,N'-bis(3-methylphenyl)-[1,1-biphenyl]-4,4'-diamine, a 1,2,4-triazine derivative such as 3-(4'-dimethylaminophenyl)-5,6-di-(4'-methoxyphenyl)-1,2,4-triazine, a hydrazone derivative such as 4-diethylaminobenzaldehyde-1,1-diphenylhydrazone, 4-diphenylaminobenzaldehyde-1,1-diphenylhydrazone, or [p-(diethylamino)phenyl](1-naphthyl)phenylhydrazone, a quinazoline derivative such as 2-phenyl-4-styryl-quinazoline, a benzofuran derivative such as 6-hydroxy-2,3-di(p-methoxyphenyl)-benzofuran, an (α-stilbene derivative such as p-(2,2-diphenylvinyl)-N,N'-diphenylaniline, an enamin derivative, a carbazole derivative such as N-ethylcarbazole, or poly-N-vinylcarbazole and a derivative thereof; electron transport materials, for example a quinone compound such as chloranil, bromoanil or anthraquinone, a tetracyanoquinodimethane compound, a fluorenone compound such as 2,4,7-trinitrofluorenone, or 2,4,5,7-tetranitro-9-fluorenone, an oxadiazole compound such as 2-(4-biphenyl)-5-(4-t-butylphenyl)-1,3,4-oxadiazole, 2,5-bis(4-naphthyl)-1,3,4-oxadiazole, or 2,5-bis(4-diethylaminophenyl)-1,3,4-oxadiazole, a xanthone compound, a thiophene compound, or a diphenoquinone compound such as 3,3',5,5'-tetra-t-butyldiphenoquinone; or a polymer having a group formed from the aforementioned compounds in a main chain or a side chain.

Such charge transport materials may be employed singly or in a combination of two or more kinds, but is preferably, in terms of mobility, those represented by the following structural formulas (A)-(C).

(A)

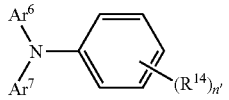

wherein, in the formula (A), $R^{14}$ represents a methyl group; n' represents an integer of 0-2; $Ar^6$ and $Ar^7$ each represents a substituted or non-substituted aryl group, —C($R^{18}$)═C($R^{19}$)($R^{20}$), or —CH═CH—CH═C$(Ar)_2$, in which a substituent is a halogen atom, an alkyl group with 1-5 carbon atoms, an alkoxy group with 1-5 carbon atoms or a substituted amino group substituted with an alkyl group with 1-3 carbon atoms, Ar represents a substituted or non-substituted aryl group, $R^{18}$, $R^{19}$ and $R^{20}$ each represents a hydrogen atom, a substituted or non-substituted alkyl group, or a substituted or non-substituted aryl group:

(B)

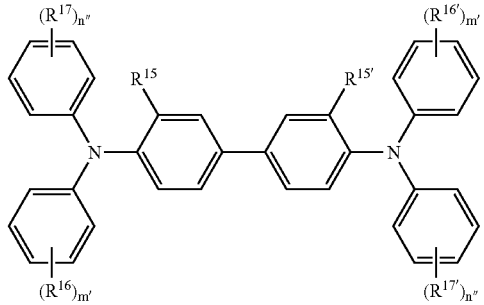

wherein, in the formula (B), $R^{15}$ and $R^{15'}$ may be mutually the same or different and each represents a hydrogen atom, a halogen atom, an alkyl group with 1-5 carbon atoms, or an alkoxy group with 1-5 carbon atoms; $R^{16}$, $R^{16'}$, $R^{17}$ and $R^{17'}$ may be mutually the same or different and each represents a hydrogen atom, a halogen atom, an alkyl group with 1-5 carbon atoms, an alkoxy group with 1-5 carbon atoms, an amino group substituted with an alkyl group with 1-2 carbon atoms, a substituted or non-substituted aryl group, —C($R^{18}$)═C($R^{19}$)($R^{20}$), or —CH═CH—CH═C$(Ar')_2$, in which Ar' represents a substituted or non-substituted aryl group, and $R^{18}$, $R^{19}$ and $R^{20}$ each represents a hydrogen atom, a substituted or non-substituted alkyl group or a substituted or non-substituted aryl group; and m' and n' each represents an integer of 0-2: and (C)

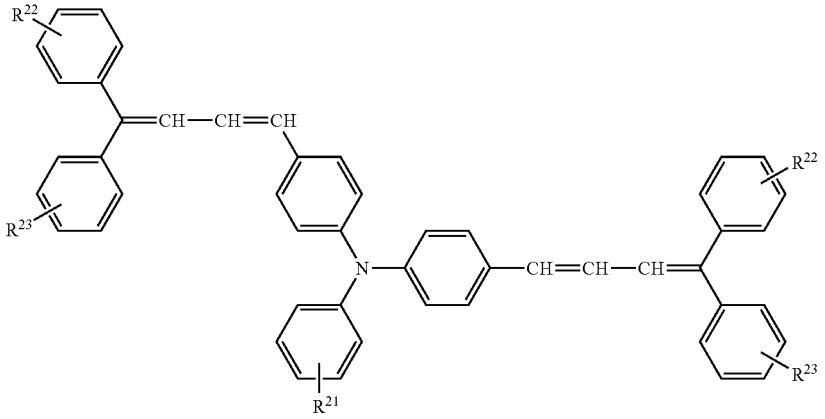

wherein, in the formula (C), $R^{21}$ represents a hydrogen atom, an alkyl group with 1-5 carbon atoms, an alkoxy group with 1-5 carbon atoms, a substituted or non-substituted aryl group, or —CH═CH—CH═C(Ar")$_2$, in which Ar" represents a substituted or non-substituted aryl group; $R^{22}$ and $R^{23}$ may be mutually same or different, and each represents a hydrogen atom, a halogen atom, an alkyl group with 1-5 carbon atoms, an alkoxy group with 1-5 carbon atoms, an amino group substituted with a 1-2 carbon atom alkyl group, or a substituted or non-substituted aryl group.

The binder resins which can be used for forming the coated layer of the charge-transporting layer 32 include a polycarbonate resin, a polyester resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin, a styrene-alkyd resin, poly-n-vinyl carbazole, polysilane, or polymeric charge-transporting materials such as polyester-based polymeric charge-transporting materials described in JP-A Nos. 8-176293 and 8-208820 the disclosure of which is incorporated by reference herein. Such binder resin can be used alone or in a mixture of two or more. A combination ratio (percentage by weight) of the charge-transporting material and the binder resin is preferably 10:1 to 1:5. Further, polymeric charge-transporting materials can be used alone. As the polymeric charge-transporting material, there can be used known compounds with charge transportability such as poly-n-vinylcarbazole and polysilane. Particularly, the polymeric polyester-based charge-transporting materials described in JP-A Nos. 8-176293 and 8-208820 are particularly preferable since they have high charge transportability. The polymeric charge-transporting materials can be used alone as a charge-transporting layer, but also be used for forming films in a mixture with a binder resin.

The charge transport layer 32, in case it is a surface layer of the electrophotographic photoreceptor (namely a layer in the photosensitive layer farthest from the conductive substrate), preferably contains lubricating particles (such as silica particles, alumina particles, fluorinated resin particles such as of polytetrafluoroethylene (PTFE), or silicone resin particles) for providing a lubricating effect thereby reducing abrasion of the surface layer and avoiding scratches, and improving the cleaning property for a developer deposited on the surface of the photoreceptor. Such lubricating particles may be employed in a mixture of two or more kinds. In particular, fluorinated resin particles can be employed preferably.

For the fluorinated resin particles, one or more kinds are preferably selected from a tetrafluoroethylene resin, a trifluorochloroethylene resin, a hexafluoropropylene resin, a fluorinated vinyl resin, a fluorinated vinylidene resin, a difluorodichloroethylene resin and copolymers thereof. A tetrafluoroethylene resin and a fluorinated vinylidene resin are particularly preferable.

The aforementioned fluorinated resin preferably has a primary particle size of 0.05 to 1 μm, more preferably 0.1 to 0.5 μm. A primary particle size less than 0.05 μm may tend to result in an agglomeration at or after dispersing operation. Also a size exceeding 1 μm may tend to generate image defects.

In a charge transport layer containing a fluorinated resin, a content of the fluorinated resin in the charge transport layer is preferably 0.1 to 40 weight % with respect to the entire amount of the charge transport layer, particularly preferably 1 to 30 weight %. A content less than 1 weight % may be insufficient for a modifying effect by the dispersed fluorinated resin particles, while a content exceeding 40 weight % may deteriorate an optical transmittance and may cause an increase in the residual potential with repeated use.

The solvents which can be used for preparing a coating solution for coating a charge-transporting layer 32 include aromatic hydrocarbons such as benzene, toluene, xylene and chlorobenzene; ketones such as acetone and 2-butanone; halogenated aliphatic hydrocarbons such as methylene chloride, chloroform, ethylene chloride; and cyclic or linear ethers such as tetrahydrofuran and ethyl ether, which these conventional organic solvents can be used alone or in a mixture of two or more thereof.

The charge-transporting layer 32 formed by any conventional technique is usable.

The charge-transporting layer 32 comprises a charge-transporting material and a binder resin, or comprises a polymeric charge-transporting material.

The coating methods used in forming the charge-transporting layer 32 include a dip coating method, a push-up coating method, a spray coating method, a roll coater coating method, a Meyer bar coating, a wire bar coating method, a gravure coater coating method, a bead coating method, a curtain coating method, a blade coating method and an air knife coating method.

The thickness of the charge-transporting layer used in the invention is generally 5 to 50 μm, preferably 10 to 40 μm.

Additives such as an antioxidant, a light stabilizer, and a heat stabilizer can be added to the photosensitive layer for the purpose of preventing the photoreceptor from being deteriorated by ozone or oxidizing gases which are generated in the electrophotographic apparatus or by light or heat. Examples of the antioxidant include hindered phenols, hindered amines, p-phenylenediamine, arylalkanes, hydroquinone, spirocoumaron, spiroindanone, derivatives thereof, organosulfur compounds, and organophosphorus compounds. Examples of the light stabilizer include derivatives of benzophenone, benzotriazole, dithiocarbamate, tetramethylpiperidine, and the like.

Also at least one electron-accepting substance may be included for the purposes of improving the sensitivity, reducing the residual potential and reducing fatigue with repeated use.

Such electron accepting substances which can be used in the invention include, for example, succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid or phthalic acid. Among these, particularly preferred are a fluorenone compound, a quinone compound and a benzene derivative having an electron attracting substituent such as Cl, CN or $NO_2$.

The protective layer 5 serves to prevent the charge-transporting layer, having a laminated structure, from undergoing a chemical change during charging or to further enhance the mechanical strength of the photosensitive layer.

The protective layer 5 comprises a binder resin (including a hardening resin) and a charge-transporting compound. The protective layer 5 may be in the form of a resin hardening film comprising a hardening resin and a charge-transporting compound, a film formed from a binder resin containing a suitable amount of an electroconductive material, and the like. Any one of known hardening resins can be used. Examples of the hardening resin include phenolic resins, polyurethane resins, melamine resins, diallyl phthalate resins, and siloxane resins.

A protective layer 5 comprising a charge-transporting compound is preferably a hardened film comprising a compound represented by the following Formulae (I-1) and (I-2).

$$F—[D—Si(R^2)_{(3-a)}Q_a]_b \qquad \text{Formula (I-1)}$$

wherein, in the formula (I-1), F represents an organic group derived from a photofunctional compound; D represents a flexible subunit; $R^2$ represents a hydrogen atom, an alkyl group or a substituted or unsubstituted aryl group; Q represents a hydrolyzable group; a represents an integer of 1-3; and b represents an integer of 1-4;

$$F—((X)_nR^1—ZH)_m \qquad \text{Formula (I-2)}$$

wherein, in the formula (I-2), F represents an organic group derived from a photofunctional compound; $R^1$ represents an alkylene group; Z represents an oxygen atom, a sulfur atom, NH, $CO_2$ or COOH; m represents an integer of 1-4; X represents an oxygen atom or a sulfur atom; and n represents 0 or 1.

In the formulas (I-1) and (I-2), F represents a unit having a photoelectric property, more specifically a photocarrier transporting property, and a structure already known as the charge transport material can be applied. More specifically, there can be utilized a skeleton of a compound having a hole transporting property, such as a triarylamine compound, a benzidine compound, an arylalkane compound, an aryl-substituted ethylene compound, a stilbene compound, an anthracene compound, or a hydrazone compound, and a skeleton of a compound having electron transporting properties, such as a quinone compound, a fluorenone compound, a xanthone compound, a benzophenone compound, a cyanovinyl compound, or an ethylene compound.

In the formula (I-1), $—Si(R^2)_{(3-a)}Q_a$ represents a substituted silicon group having a hydrolysable group, in which the substituted silicon atom causes a mutual crosslinking reaction with a Si group, thereby forming a three-dimensional Si—O—Si bond. Thus, the substituted silicon group serves to form so-called inorganic glass-like network in the protective layer 5.

In the formula (I-1), D represents a flexible subunit, more specifically an organic group serving to connect an F portion for realizing a photoelectric property with a substituted silicon group which is directly connected with the three-dimensional inorganic glass-like network and providing an inorganic glass-like network which is hard but brittle with an adequate flexibility and improving the toughness of the film.

The unit D can be, more specifically, a divalent hydrocarbon group represented by $—C_nH_{2n}—$, $—C_nH_{(2n-2)}—$ or $—C_nH_{(2n-4}—$ (wherein n represents an integer of 1-15), —COO—, —S—, —O—, $—CH_2—C_6H_4—$, —N=CH—, $—(C_6H_4)—(C_6H_4)—$, a characteristic group formed by arbitrarily combining these groups, or such characteristic group in which a structural atom is substituted by another substituent.

In the formula (I-1), b is preferably 2 or larger. In case b is 2 or larger, the photofunctional organic silicon compound represented by the formula (I-1) contains two or more Si atoms, thus becoming easier to form an inorganic glass-like network and increasing the mechanical strength thereof.

Among the formulas (I-1) and (I-2), a compound in which the organic group F is represented by a following formula (I-3) is particularly preferable. A compound represented by the formula (I-3) is a compound having a hole transporting property (hole transport material), and the presence of such compound in the protective layer 5 is preferable in terms of improvement in the photoelectric properties and the mechanical properties of the protective layer 5.

Formula (I-3)

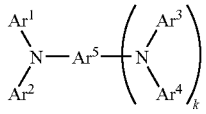

In Formula (I-3), $Ar^1$ to $A^4$ each independently represent a substituted or unsubstituted aryl group, and $Ar^5$ represents a substituted or unsubstituted aryl group or arylene group, provided that 2 to 4 of $Ar^1$ to $Ar^5$ have a bond represented by $—D—Si(R^2)_{(3-a)}Q_a$ or $—((X)_nR_1—ZH)_m$. D represents a flexible subunit. $R^2$ represents a hydrogen atom, an alkyl group or a substituted or unsubstituted aryl group. Q represents a hydrolysable group. a represents an integer of 1 to 3. $R_1$ represents an alkylene group, Z represents an oxygen atom, a sulfur atom or NH, $CO_2$ or COOH, and m represents an integer of 1 to 4. X represents an oxygen atom or a sulfur atom, and n represents 0 or 1.

In Formula (I-2), to be more specific, $Ar^1$ to $Ar^5$ are preferably represented by the following Formulae (I-4) to (I-10).

TABLE 1

| | |
|---|---|
| (I-4) | 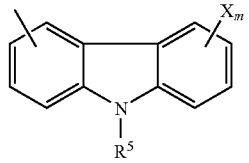 |
| (I-5) | 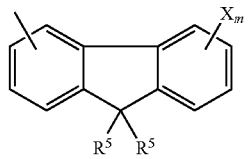 |
| (I-6) | 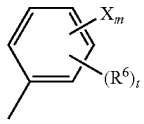 |
| (I-7) | 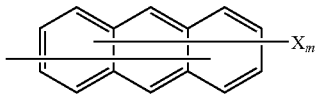 |
| (I-8) | 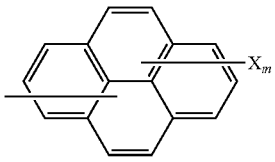 |
| (I-9) | 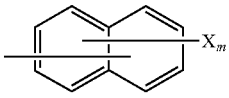 |
| (I-10) | $—Ar—(Z')_s—Ar—X_m$ |

In the formulas (I-4) to (I-10), $R^5$ each independently represents a group selected from a hydrogen atom, an alkyl group with 1 to 4 carbon atoms, a phenyl group substituted with an alkyl group with 1 to 4 carbon atoms or an alkoxy group with 1 to 4 carbon atoms, a non-substituted phenyl group, and an aralkyl group with 7 to 10 carbon atoms; $R^6$ represents a group selected from a hydrogen atom, an alkyl group with 1 to 4 carbon atoms, an alkoxy group with 1 to 4 carbon atoms, and a halogen atom; X represents a characteristic group of a structure represented by —D—$Si(R^2)_{(3-a)}Q_a$; m and s each represents 0 or 1; and t represents an integer of 1-3.

In the formula (I-10), Ar is preferably represented by following formulas (I-11) to (I-12).

TABLE 2

| | |
|---|---|
| (I-11) | 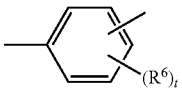 |
| (I-12) | 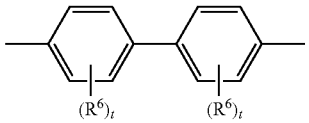 |

In the formulas (I-11) and (I-12), $R^6$ has the same meaning as $R^6$ mentioned before; and t represents an integer of 1-3.

In the formula (I-10), Z' is preferably represented by following formulas (I-13) to (I-14).

Also in the formulas (I-4) to (I-10), X represents a characteristic group of a structure represented by —D—$Si(R^2)_{(3-a)}Q_a$ as described before. In such characteristic group, D represents divalent hydrocarbon group represented by —$C_1H_{21}$—, —$C_mH_{(2m-2)}$— or —$C_nH_{(2n-4)}$— (wherein 1 represents an integer of 1-15, m represents an integer of 2-15 and n represents an integer of 3-15), —N═CH—, —O—, —COO—, —S—, —$(CH)_\beta$— (β representing an integer of 1-10), or a characteristic group represented by the aforementioned formula (I-11) or (I-12) or following formulas (I-13) and (I-14).

TABLE 3

| | |
|---|---|
| (I-13) | 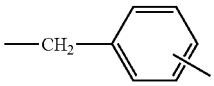 |
| (I-14) | 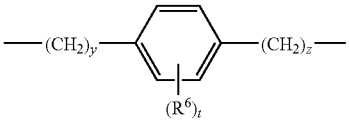 |

In the formula (I-14), y and z each represents an integer of 1-5; t represents an integer of 1-3; and $R^6$ represents, as described before, one selected from a group of a hydrogen atom, an alkyl group with 1 to 4 carbon atoms, an alkoxy group with 1 to 4 carbon atoms, and a halogen atom.

In the formula (I-3), $Ar^5$ represents a substituted or non-substituted aryl or arylene group, and, in case of k=0, there is preferred a group corresponding to any of formulas (I-15) to (I-19) shown in Table 4, and, in case of k=1, there is preferred a group corresponding to any of formulas (I-20) to (I-24) shown in Table 5.

TABLE 4

| | |
|---|---|
| (I-15) | 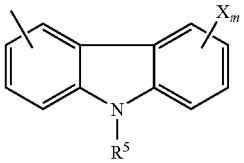 |
| (I-16) | 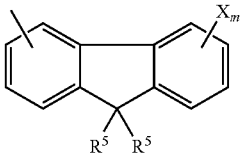 |
| (I-17) | 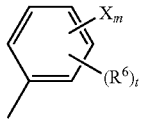 |
| (I-18) | 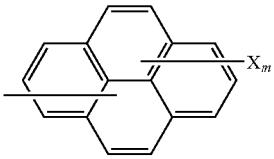 |
| (I-19) | —Ar—$(Z)_s$—Ar—X |

TABLE 5

| | |
|---|---|
| (I-20) | 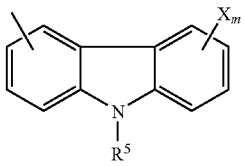 |
| (I-21) | 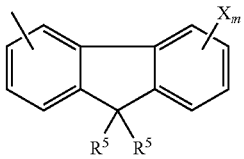 |
| (I-22) | 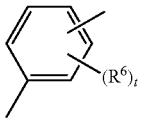 |
| (I-23) | 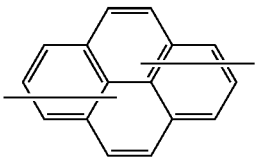 |
| (I-24) | —Ar—$(Z)_s$—Ar— |

In Formulae (I-15) to (I-24), $R^5$ each independently represents at least one selected from the group consisting of a hydrogen atom, an alkyl group having 1 to 4 carbon atoms, a phenyl group substituted with an alkyl group having 1 to 4 carbon atoms or alkoxy group having 1 to 4 carbon atoms, an unsubstituted phenyl group and an aralkyl group having 7 to 10 carbon atoms. Further, $R^6$ represents at least one selected from the group consisting of a hydrogen atom, an alkyl group having 1 to 4 carbon atoms, an alkoxy group having 1 to 4 carbon atoms and a halogen atom; s represents 0 or 1; and t represents an integer of I to 3.

Also in case $Ar^5$ in the formula (I-3) assumes any of the structures shown by the formulas (I-15) to (I-19) in Table 4 and the formulas (I-20) to (I-24) in Table 5, formulas (I-19) and (I-24) is preferably one selected from a group of following formulas (I-25) to (I-32).

TABLE 6

| | |
|---|---|
| (I-25) | $—(CH_2)_q—$ |
| (I-26) | $—(CH_2CH_2O)_r—$ |
| (I-27) | 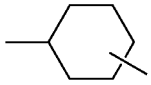 |
| (I-28) | 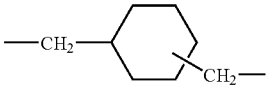 |
| (I-29) | 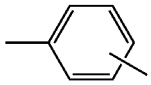 |
| (I-30) | 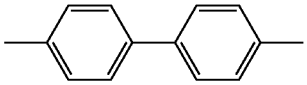 |
| (I-31) | 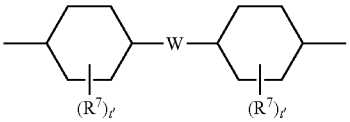 |
| (I-32) | 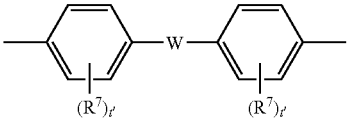 |

In the formulas (I-25) and (I-32), $R^7$ each represents one selected from a group of a hydrogen atom, an alkyl group with 1 to 4 carbon atoms, an alkoxy group with 1 to 4 carbon atoms and a halogen atom; W represents a divalent group; q and r each represents an integer of 1-10; and t' represents an integer of 1-2.

In the formulas (I-31) and (I-32), W is preferably any one of divalent groups represented by following formulas (I-33) to (I-41). In the formula (I-40), s' represents an integer of 0-3.

| | |
|---|---|
| $—CH_2—$ | (I-33) |
| $—C(CH_3)_2—$ | (I-34) |
| —O— | (I-35) |
| —S— | (I-36) |
| $—C(CF_3)_2—$ | (I-37) |
| $—Si(CH_3)_2—$ | (I-38) |

TABLE 7

| | |
|---|---|
| (I-39) | 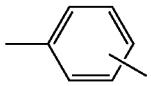 |
| (I-40) | 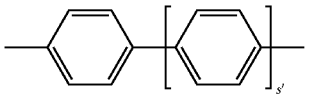 |
| (I-41) | 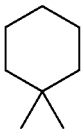 |

Also the specific examples of the compound represented by the formula (I-3) given in JP-A No. 2001-83728, the disclosure of which is incorporated by reference herein, by compounds Nos. 1-274 shown in tables 1-55 may be used.

The charge transport compound represented by the formula (I-1) may be employed singly or in a combination of two or more kinds.

In combination with the charge transport compound represented by the formula (I-1), for the purpose of further improving the mechanical strength of the cured film, a compound represented by a following formula (II) may be employed.

$$B—(Si(R^2)_{(3-a)}Q_a)_2 \qquad \text{Formula (II)}$$

In the formula (II), B represents a divalent organic group; $R^2$ represents a hydrogen atom, an alkyl group or a substituted or non-substituted aryl group; Q represents a hydrolysable group; and a represents an integer of 1-3.

The compound represented by the formula (II) is preferably one represented by following formulas (II-1) to (II-5), but the present invention is not limited to such structures.

In the formulas (II-1) to (II-5), $T^1$ and $T^2$ each independently represents a divalent or trivalent hydrocarbon group that may be branched; A represents a substituted silicon group having a hydrolysable property as explained before; h, i and j each independently represents an integer of 1-3. The compound represented by the formulas (II-1) to (II-5) is so selected that a number of A in the molecule is 2 or more.

TABLE 8

| | |
|---|---|
| (II-1) | $T^1$—[A]$_j$ |
| (II-2) | 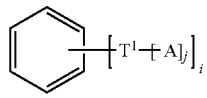 |
| (II-3) | 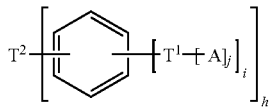 |
| (II-4) | HN—[$T^1$—A]$_2$ |
| (II-5) |  |

In the following, preferred specific examples of the compound represented by the formula (II) are shown by following formulas (III-1) to (III-19) in Tables 9 and 10. In Tables 9 and 10, Me, Et and Pr respectively represent a methyl group, an ethyl group and a propyl group.

TABLE 9

| | |
|---|---|
| (III-1) | 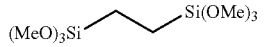 |
| (III-2) | 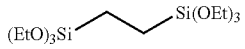 |
| (III-3) | 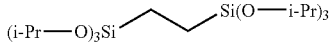 |
| (III-4) | 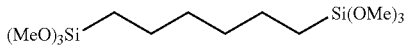 |
| (III-5) | 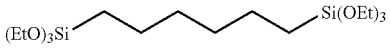 |
| (III-6) | 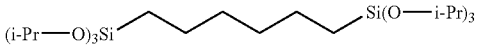 |
| (III-7) | 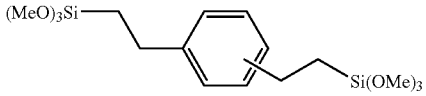 |
| (III-8) | 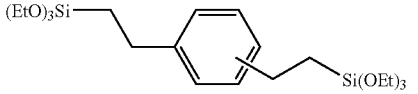 |
| (III-9) | 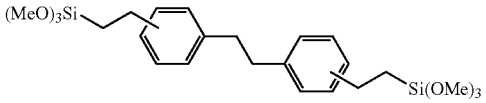 |
| (III-10) | 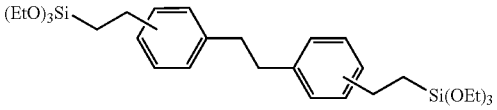 |
| (III-11) | 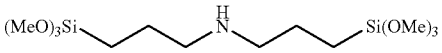 |
| (III-12) | 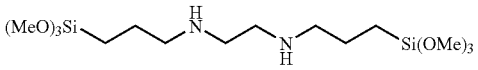 |

TABLE 10

| | |
|---|---|
| (III-13) | $(MeO)_2MeSi(CH_2)_2SiMe(OMe)_2$ |
| (III-14) | $(EtO)_2EtSi(CH_2)_2SiEt(OEt)_2$ |
| (III-15) | $(MeO)_2MeSi(CH_2)_6SiMe(OMe)_2$ |
| (III-16) | $(EtO)_2EtSi(CH_2)_6SiEt(OEt)_2$ |
| (III-17) | $(MeO)_2MeSi(CH_2)_{10}SiMe(OMe)_2$ |
| (III-18) | $(EtO)_2EtSi(CH_2)_{10}SiEt(OEt)_2$ |
| (III-19) | $MeOMe_2Si(CH_2)_6SiMe_2OMe$ |

Another compound capable of a crosslinking reaction may be employed in combination with the compound represented by the formula (I-1) or (I-2). Such compound can be a silane coupling agent, or a commercially available silicone hard coating agent.

The silane coupling agent can be vinyltrichlorosilane, vinyltrimethoxysilane, vinyltriethoxysilane, γ-glycidoxypropylmethyl diethoxysilane, γ-glycidoxypropyl triethoxysilane, γ-glycidoxypropyl trimethoxysilane, γ-aminopropyl triethoxysilane, γ-aminopropyl trimethoxysilane, γ-aminopropylmethyl dimethoxysilane, N-β(aminoethyl)γ-aminopropyl triethoxysilane, tetramethoxysilane, methyltrimethoxysilane, or dimethyldimetlhoxysilane.

The commercially available hard coating agent can be KP-85, CR-39, X-12-2208, X-40-9740, X-41-1007, KNS-5300, X-40-2239 (manufactured by Shin-etsu Chemical Co.), and AY42-440, AY42-441 and AY49-208 (manufactured by Dow Corning Toray Silicone Co.).

In the protective layer 5, a fluorine atom-containing compound may be added for the purpose of providing a surface lubricating property. An increase in the surface lubricating property can reduce the friction coefficient with a cleaning member and can improve the abrasion resistance. It may has the effect of preventing deposition of discharge product, developer and paper dust onto the surface of the electrophotographic photoreceptor, thereby extending the service life thereof.

As specific examples of the fluorine-containing compound, it is possible to add a fluorine atom-containing polymer such as polytetrafluoroethylene directly, or to add fine particles of such a polymer.

In case the protective layer 5 is a cured film formed by the compound represented by the formula (I), it is preferable to add a fluorine-containing compound capable of reacting with alkoxysilane and constituting a part of the crosslinked film.

Specific examples of such fluorine atom-containing compound include (tridecafluoro-1,1,2,2-tetrahydrooctyl) triethoxysilane, (3,3,3-trifluoropropyl) trimethoxysilane, 3-(heptafluoroisopropoxy)propyl triethoxysilane, 1H,1H,2H,2H-perfluoroalkyl triethoxysilane, 1H,1H,2H,2H-perfluorodecyl triethoxysilane, and 1H,1H,2H,2H-perfluorooctyl triethoxysilane.

An amount of addition of the fluorine-containing compound is preferably 20 weight % or less. An exceeding amount may cause a defect in the film forming property of the crosslinked cured film.

The aforementioned protective layer 5 has a sufficient antioxidation property, but an antioxidant may be added in order to obtain an even stronger antioxidation property.

The antioxidant is preferably a hindered phenol type or a hindered amine type, but it is also possible to employ a known antioxidant such as an organic sulfur-based antioxidant, a phosphite antioxidant, a dithiocarbamate antioxidant, a thiourea antioxidant, or an benzimidazole antioxidant. An amount of addition of the antioxidant is preferably 15 weight % or less, more preferably 10 weight % or less.

Examples of the hindered phenol type antioxidant include 2,6-di-t-butyl-4-methylphenol, 2,5-di-t-butylhydroquinone, N,N'-hexamethylenebis(3,5-di-t-butyl-4-hydroxyhydrocinnamide), 3,5-di-t-butyl-4-hydroxy-benzyl phosphonate diethyl ester, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenyl), 4,4'-butylidenebis(3-methyl-6-t-butylphenol), 2,5-di-t-amylhydroquinone, 2-t-butyl-6-(3-butyl-2-hydroxy-5-methylbenzyl)-4-methylphenyl acrylate, and 4,4'-butylidenebis(3-methyl-6-t-butylphenol).

In the protective layer 5, other known additives employed in film formation may be added, such as a leveling agent, an ultraviolet absorber, a photostabilizer, a surfactant and the like.

The protective layer 5 is formed by coating a mixture of the aforementioned materials and other additives on the photosensitive layer, followed by heating. In this manner a three-dimensional crosslinking curing reaction is induced to form a firm cured film. The heating may be executed at any temperature which does not influence the underlying photosensitive layer, but is preferably executed within a range from room temperature to 200° C., and particularly from 100° C. to 160° C.

In forming the protective layer 5, the crosslinking curing reaction may be executed without a catalyst or with a suitable catalyst. The catalyst can be an acid catalyst such as hydrochloric acid, sulfuric acid, phosphoric acid, formic acid, acetic acid or trifluoroacetic acid; a base such as ammonia or triethylamine; an organic tin compound such as dibutyl tin diacetate, dibutyl tin dioctoate or stannous octoate; an organic titanium compound such as tetra-n-butyl titanate or tetraisopropyl titanate; or an iron salt, a manganese salt, a cobalt salt, a zinc salt, a zirconium salt or an aluminum chelate compound of an organic carboxylic acid.

In the protective layer 5, a solvent may be added, if necessary, in order to facilitate coating. More specifically there can be employed water or an ordinary organic solvent such as methanol, ethanol, n-propanol, i-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, dimethyl ether or dibutyl ether. Such solvents may be employed singly or in a mixture of two or more kinds.

In forming the protective layer 5, the coating can be executed by an ordinary coating method such as blade coating, Meyer bar coating, spray coating, dip coating, bead coating, air knife coating, or curtain coating.

The protective layer 5 has a thickness of 0.5 to 20 μm, preferably 2 to 10 μm.

In the electrophotographic photoreceptor 7, the film thickness of the functional layer, as the upper layers above the charge-generating layer, is 50 μm or less, and preferably 40 μm or less in order to obtain a high resolution.

The electrophotographic photoreceptor 7 is not restricted to the above constitution. For example, there may also be used an electrophotographic photoreceptor 7 which does not comprise the protective layer 5. That is, there may also be used the constitution wherein an interlayer 2 and the photosensitive layer 3 comprising a charge-generating layer 31 and a charge-transporting layer 32 on an electroconductive substrate 1.

(Electrophotographic Apparatus)

Figure 2:
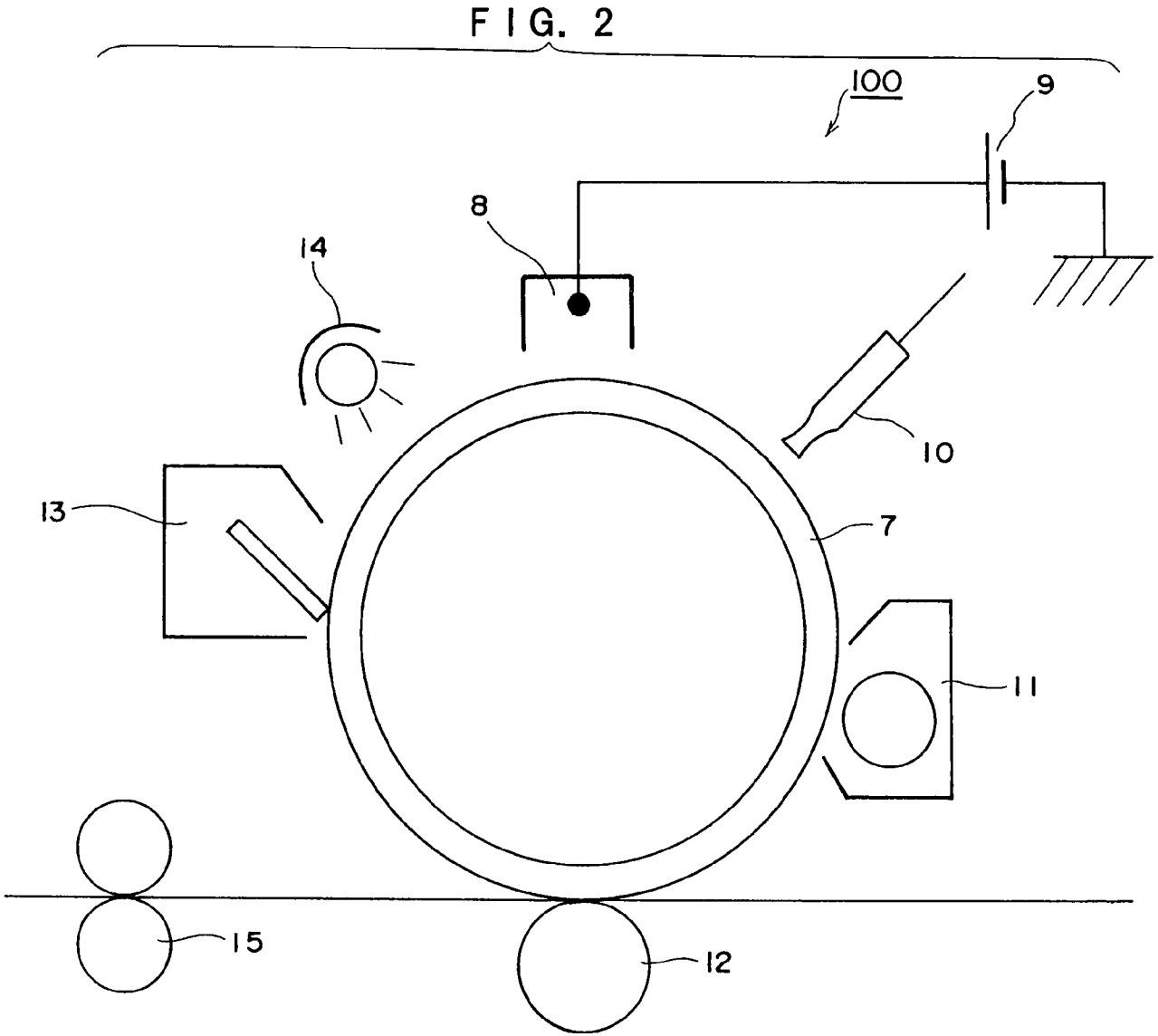
FIG. 2 is a schematic view illustrating one preferred embodiment of an electrophotographic apparatus of the invention.

FIG. 2 is a schematic view showing a preferable embodiment of an electrophotographic apparatus of the present invention. An electrophotographic apparatus 100 shown in FIG. 2 is provided with a drum-shaped (cylindrical) electrophotographic photoreceptor 7 of the invention, provided in a rotatable manner. Around the electrophotographic photoreceptor 7, there are provided, along a moving direction of an external periphery thereof, a charging apparatus 8, an exposure apparatus 10, a developing apparatus 11, a transfer apparatus 12, a cleaning apparatus 13 and a charge eliminator (erasing apparatus) 14.

A charging apparatus 8 of a corona charging type is used for charging the electrophotographic photoreceptor 7. The charging apparatus 8 may be constituted of a corotron charger or a scorotron charger. The charging apparatus 8 is connected to a power source 9.

An exposure apparatus 10 exposes the charged electrophotographic photoreceptor 7 to a light, thereby forming an electrostatic latent image thereon.

A developing apparatus 11 develops the electrostatic latent image with a developer to form a toner image. The developer preferably includes toner particles of a volume average particle size of 3 to 9 μm, obtained by a polymerization method.

A transfer apparatus 12 transfers the toner image, developed on the electrophotographic photoreceptor 7, onto a transfer medium.

A cleaning apparatus 13 removes a toner remaining on the electrophotographic photoreceptor 7 after the transfer. The cleaning apparatus 13 preferably has a blade member maintained in contact with the electrophotographic photoreceptor 7 under a linear pressure of 10-150 g/cm.

A charge eliminator (erasing apparatus) 14 erases a retentive charge on the electrophotographic photoreceptor 7.

The electrophotographic apparatus 100 is provided with a fixing apparatus 15 for fixing, after the transfer step, the toner image to the transfer medium.

Figure 3:
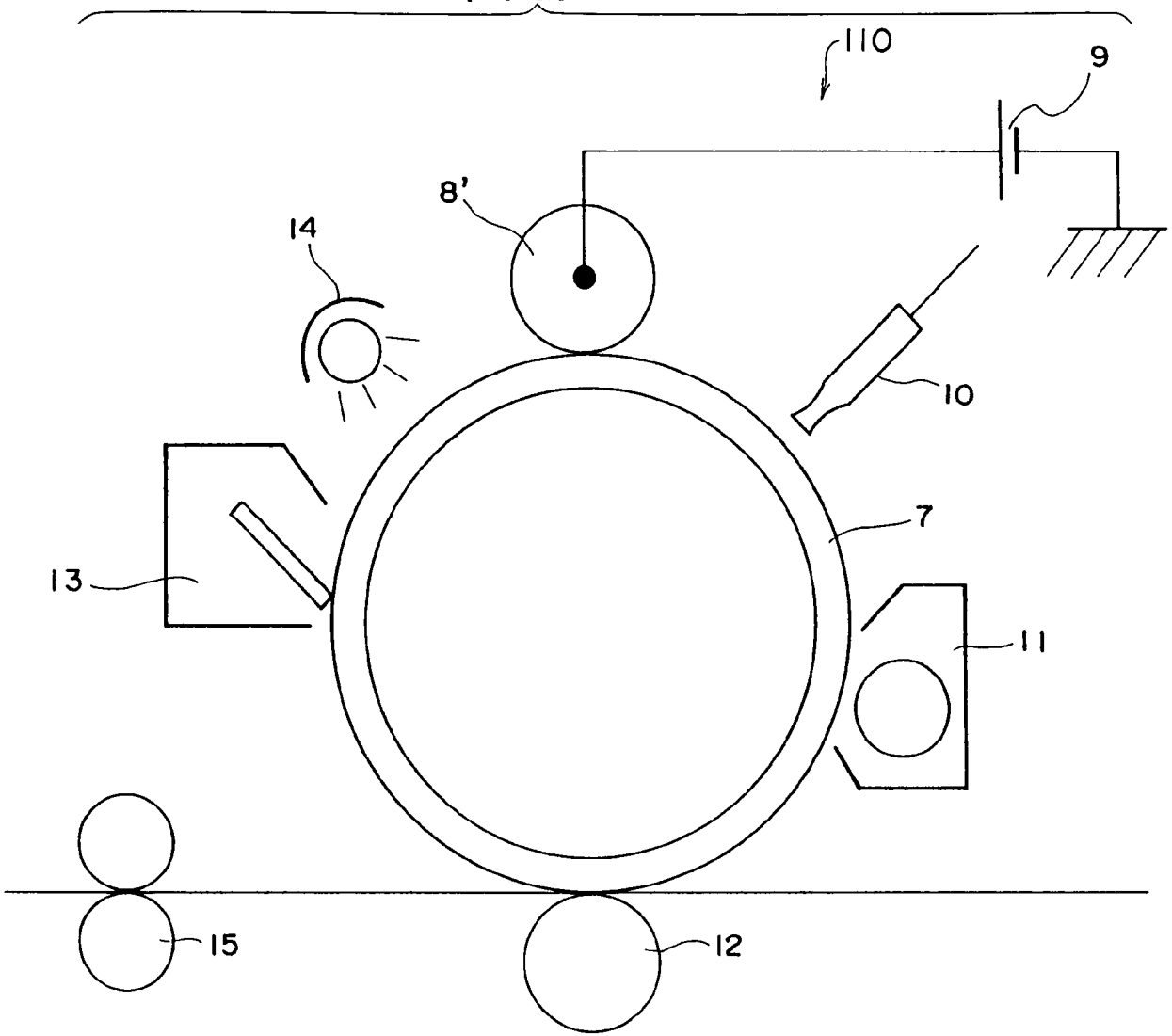
FIG. 3 is a schematic view illustrating another preferred embodiment of an electrophotographic apparatus of the invention.

FIG. 3 is a schematic view showing another preferred embodiment of the electrophotographic apparatus of the invention. An electrophotographic apparatus 110 shown in FIG. 3 is similar, in structure, to the electrophotographic apparatus 100 shown in FIG. 2, except that it is equipped with a charging apparatus 8' for charging the electrophotographic photoreceptor 7 in a contact method. In the electrophotographic apparatus 110 with a contact charging apparatus utilizing a DC voltage superposed with an AC voltage, the electrophotographic photoreceptor 7 can be advantageously employed because of an excellent leak resistance. In this case, the charge eliminator 14 may not need to be provided.

In the contact charging method, a charging member of a roller shape, a blade shape, a belt shape, a brush shape, a pin-electrode shape, or a magnetic brush shape can be utilized. Particularly in case of a roller-shaped or blade-shaped charging member, such charging member may be positioned, with respect to the photoreceptor, in a contact state or in a non-contact state with a certain gap (100 μm or less) thereto.

A roller-shaped, blade-shaped or belt-shaped charging member is constituted of a material regulated to an electrical resistance ($10^3$-$10^8\Omega$) suitable for a charging member, and may be constituted of a single layer or plural layers.

It can be formed of an elastomer constituted of a synthetic rubber such as urethane rubber, silicone rubber, fluorinated rubber, chloroprene rubber, butadiene rubber, EPDM or epichlorohydrin rubber, or of polyolefin, polystyrene or polyvinyl chloride, blended with an appropriate amount of a conductivity providing material such as conductive carbon, a metal oxide or an ionic conductive material thereby exhibiting an effective electroconductivity as a charging member.

It is also possible to prepare a paint of a resin such as nylon, polyester, polystyrene, polyurethane or silicone, blending therein an appropriate amount of a conductivity providing material such as conductive carbon, a metal oxide or an ionic conductive material and laminating thus obtained paint by a suitable method such as a dip, a spraying or a roll coating.

On the other hand, a brush-shaped charging member can be prepared by subjecting already known fibers of acrylic resin, nylon or polyester, rendered electroconductive, to a fluorine impregnating process and then implanting such fibers using an already known method. The fluorine impregnating process may be executed after the fibers are formed into a brush-shaped charging member.

The brush-shaped charging member herein includes a roller-shaped member and a charging member having fibers planted on a flat plate, and is not limited to a particular shape. Also a magnetic brush-shaped charging member includes ferrite or magnetite, showing magnetic properties, arranged radially on an external periphery of a cylinder incorporating multi-pole magnets, and the ferrite or magnetite is preferably subjected to a fluorine impregnating process prior to the formation into a magnetic brush.

Figure 4:
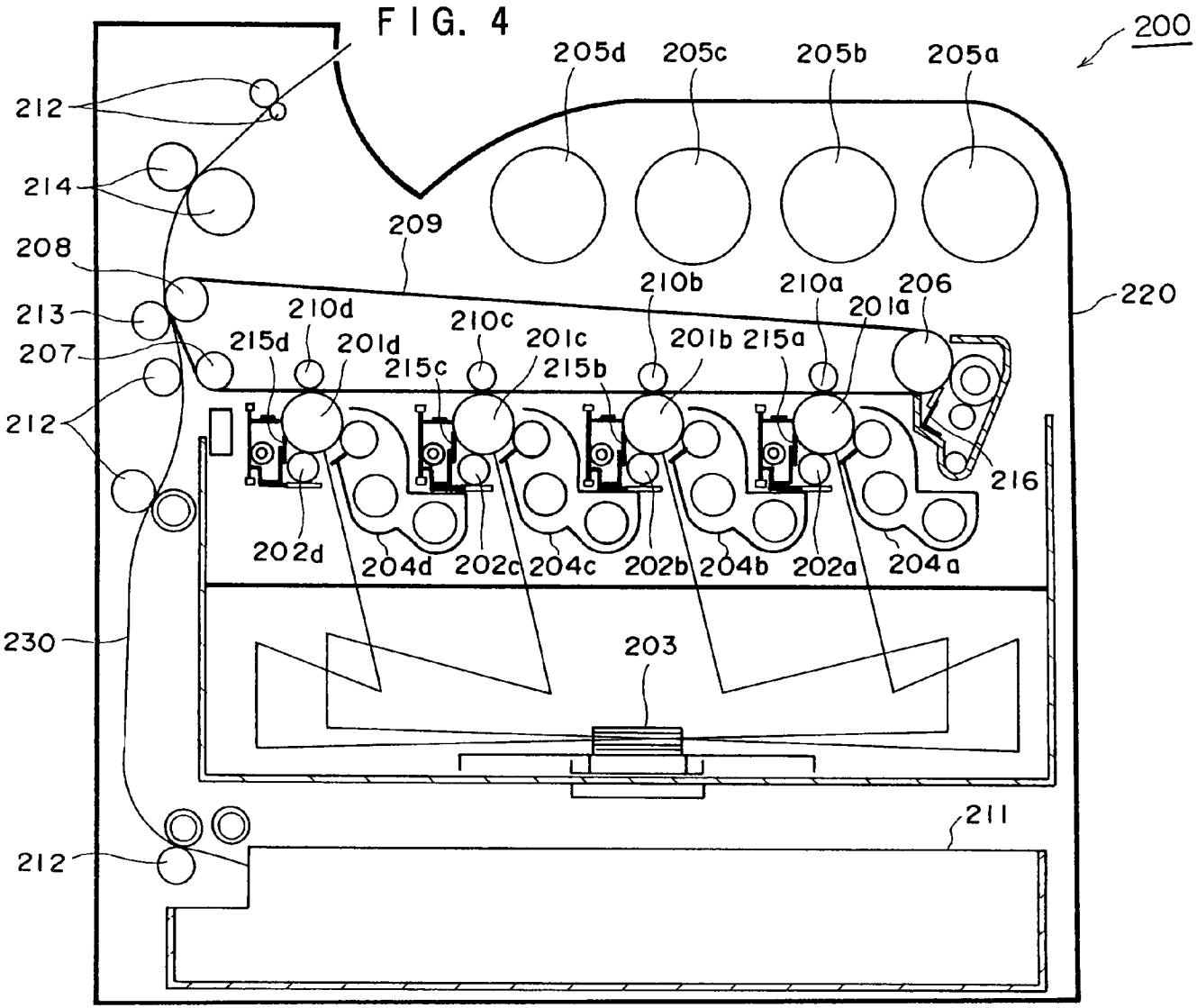
FIG. 4 is a schematic view illustrating another preferred embodiment of an electrophotographic apparatus of the invention.

FIG. 4 is a schematic view showing another preferred embodiment of the electrophotographic apparatus of the invention. An electrophotographic apparatus 200 is of a tandem type with intermediate transfer method. In an housing 220, four electrophotographic photoreceptors 201*a*-201*d* (for example 201*a* for yellow color, 201*b* for magenta color, 201*c* for cyan color and 201*d* for black color image formation) are arranged mutually parallel and along an intermediate transfer belt 209.

For transferring a visible image onto a transfer sheet such as paper, a transfer drum method is already known in which the transfer sheet such as paper is wound on a transfer drum and visible images of respective colors on the photoreceptor are transferred onto such transfer sheet. In this case, an transfer drum has to be rotated plural turns for transferring the visible images from the photoreceptors to the transfer sheet, but, in the tandem intermediate transfer method, the transfer from plural photoreceptors 201*a*-201*d* can be achieved in a single turn of the intermediate transfer member 209. This transfer method is promising hereafter because of the higher transfer speed thus achievable and an advantage that the transfer medium need not be selective as in the case of the transfer drum method.

The electrophotographic photoreceptors 201*a*-201*d* mounted in the electrophotographic apparatus 200 are respectively similar to the electrophotographic photoreceptor 7.

The electrophotographic photoreceptors 201*a*-201*d* are respectively rotated in a predetermined direction (counterclockwise in the illustration), and, charging rollers 202*a*-202*d*, developing apparatuses 204*a*-204*d*, primary transfer rollers 210*a*-210*d*, and cleaning apparatuses 215*a*-215*d* are arranged along the direction of rotation. Toners of four colors of yellow, magenta, cyan and black, respectively contained in toner cartridges 205*a*-205*d*, can be respectively supplied to the developing apparatuses 204*a*-204*d*. Also the primary transfer rollers 210*a*-210*d* are respectively in contact with the electrophotographic photoreceptors 201*a*-201*d* across the intermediate transfer belt 209.

In a predetermined position of the housing 220, a laser light source (exposure apparatus) 203 is positioned. A laser light emitted from the laser light source 203 is so guided to irradiate the surfaces of the electrophotographic photoreceptors 201*a*-201*d* after the charging, whereby steps of charging, exposure, development, primary transfer and cleaning are executed in succession in the course of rotation of the electrophotographic photoreceptors 201*a*-201*d*, and toner images of the respective colors are transferred in superposition onto the intermediate transfer belt 209.

The intermediate transfer belt 209 is supported under a predetermined tension by a driving roller 206, a backup roller 208 and a tension roller 207, and is rendered rotatable without slack by the rotation of these rollers. A secondary transfer roller 213 is so positioned as to contact the backup roller 208 across the intermediate transfer belt 209.

The intermediate transfer belt 209, after passing between the backup roller 208 and the secondary transfer roller 213, is subjected to a surface cleaning by a cleaning blade 216 positioned for example in the vicinity of the driving roller 206 and is then used again for a next image formation process.

A tray (transfer medium tray) 211 is provided in a predetermined position within the housing 220, and a transfer medium 230 such as paper contained in the tray 211 is transferred, by a transfer roller 212, in a path between the intermediate transfer belt 209 and the secondary transfer roller 213 and also between mutually contacting two fixing rollers 214, and is then discharged to the exterior of the housing 220.

In the foregoing, there has been explained a case in which the intermediate transfer belt 209 is employed as an intermediate transfer member, but the intermediate transfer member may be constructed as a belt shape (for example as an endless belt), as in the case of the intermediate transfer belt 209, or as a drum shape. In case of employing a belt-shaped structure such as the intermediate transfer belt 209 as the intermediate transfer member, such belt preferably has a thickness of 50 to 500 μm, more preferably 60 to 150 μm. The thickness of the belt can be suitably selected according the hardness of the material. Also in the case of employing a drum-shaped structure as the intermediate transfer member, a substrate is preferably constituted of a cylindrical substrate formed, for example, of aluminum, stainless steel (SUS) or copper. On such a cylindrical substrate, an elastic layer may be provided if necessary, and a surface layer can be formed on such an elastic layer.

The transfer medium mentioned in the invention may be any medium to which a toner image formed on the electrophotographic photoreceptor is transferred. For example, in case of direct transfer from the electrophotographic photoreceptor to a paper or the like, such paper or the like constitutes the transfer medium, and, in case of employing an intermediate transfer member, such intermediate transfer member constitutes the transfer medium.

As the material constituting the aforementioned endless belt, there is proposed a semiconductive endless belt of a thermoplastic material such as a polycarbonate resin (PC), a polyvinylidene fluoride (PVDF), polyalkylene phthalate, a PC/polyalkylene phthalate (PAT) blend, or an ethylene-tetrafluoroethylene copolymer (ETFE).

Also Japanese Patent No. 2560727 and JP-A No. 5-77252 propose an intermediate transfer member in which ordinary carbon black is dispersed as a conductive powder in a polyimide resin.

An intermediate transfer member that does not easily cause image defects, such as color slippage, can be obtained since the polyimide resin, having a high Young's modulus, shows little deformation under driving (under stresses from the supporting roller, cleaning blade and the like). The polyimide resin is usually obtained as a polyamidic acid solution by a polymerization reaction of a tetracarboxylic acid dianhydride or a derivative thereof with a diamine in approximately equimolar amounts in solvent. The tetracarboxylic acid dianhydride is, for example, represented by a following formula (IV):

(IV)

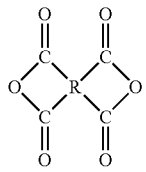

In the formula (IV), R represents a tetravalent organic group selected from the group of an aliphatic linear hydrocarbon group, an alicyclic hydrocarbon group, an aromatic hydrocarbon group, and such hydrocarbon groups to which a substituent is bonded.

Specific examples of tetracarboxylic acid dianhydride include pyromellitic acid dianhydride, 3,3',4,4'-benzophenonetetracarboxylic acid dianhydride, 3,3',4,4'-biphenyltetracarboxylic acid dianhydride, 2,3,3',4-biphenyltetracarboxylic acid dianhydride, 2,3,6,7-naphthalenetetracarboxylic acid dianhydride, 1,2,5,6-naphthalenetetracarboxylic acid dianhydride, 1,4,5,8-naphthalenetetracarboxylic acid dianhydride, 2,2'-bis(3,4-dicarboxyphenyl)sulfonic acid dianhydride, perylene-3,4,9,10-tetracarboxylic acid dianhydride, bis(3,4-dicarboxyphenyl) ether dianhydride, and ethylenetetracarboxylic acid dianhydride.

On the other hand, specific examples of diamine include 4,4'-diaminodiphenyl ether, 4,4'-diaminodiphenylmethane, 3,3'-diaminodiphenylmethane, 3,3'-dichlorobenzidine, 4,4'-diaminodiphenylsulfide, 3,3'-diaminodiphenylsulfon, 1,5-diaminonaphthalene, m-phenylenediamine, p-phenylenediamine, 3,3'-dimethyl-4,4'-biphenyldiamine, benzidine, 3,3'-dimethylbenzidine, 3,3'-dimethoxybenzidine, 4,4'-diaminodiphenylsulfon, 4,4'-diaminodiphenylpropane, 2,4-bis(β-amino-tert-butyl)toluene, bis(p-β-amino-tert-butylphenyl)ether, bis(p-β-methyl-δ-aminophenyl)benzene, bis-p-(1,1-dimethyl-5-aminopentyl)benzene, 1-isopropyl-2,4-m-phenylenediamine, m-xylilenediamine, p-xylilenediamine, di(p-aminocyclohexyl)methane, hexamethylenediamine, heptamethylenediamine, octamethylenediamine, nonamethylenediamine, decamethylenediamine, diaminopropyltetramethylene, 3-methylheptamethylenediamine, 4,4-dimethylheptamethylenediamine, 2,11-diaminododecane, 1,2-bis-3-aminopropoxyethane, 2,2-dimethylpropylenediamine, 3-methoxyhexamethylenediamine, 2,5-dimethylheptamethylenediamine, 3-methylheptamethylenediamine, 5-methylnonamethylenediamine, 2,17-diaminoeicosadecane, 1,4-diaminocyclohexane, 1,10-diamino-1,10-dimethyldecane, 12-diaminooctadecane, 2,2-bis[4-(4-aminophenoxy)phenyl]propane, piperadine, $H_2N(CH_2)_{30}(CH_2)_{20}(CH_2)NH_2$, $H_2N(CH_2)_3S(CH_2)_3NH_2$, and $H_2N(CH_2)_3N(CH_3)_2(CH_2)_3NH_2$.

The solvent to be used in the polymerization reaction of the tetracarboxylic acid dianhydride and the diamine is advantageously a polar solvent in consideration of solubility and the like. The polar solvent is preferably an N,N-dialkylamide, and more specifically of a lower molecular weight, such as N,N-dimethylformamide, N,N-dimethylacetamide, N,N-diethylformamide, N,N-diethylacetamide, N,N-dimethylmethoxyacetamide, dimethylsulfoxide, hexamethylphosphonyltriamide, N-methyl-2-pyrrolidone, pyridine, tetramethylenesulfone and dimethyltetramethylenesulfone. Such solvents may be employed singly or in a combination of two or more kinds.

The intermediate transfer member contains oxidation-processed carbon black in a polyimide resin. The oxidation-processed carbon black can be obtained by an oxidation process of carbon black thereby providing the surface thereof with an oxygen-containing functional group (such as a carboxyl group, a quinone group, a lactone group or a hydroxyl group).

Such an oxidation process can be achieved for example by an air oxidation method of contacting and reacting with air in a high-temperature environment, a method of contacting with a nitrogen oxide or ozone at normal temperature, or a method of ozone oxidation at a low temperature after air oxidation at a high temperature.

Examples of oxidized carbon include products of Mitsubishi Chemical Corporation such as MA100 (pH 3.5, volatiles 1.5%), MA100R (pH 3.5, volatiles 1.5%), MA100S (pH 3.5, volatiles 1.5%), #970 (pH 3.5, volatiles 3.0%), MA11 (pH 3.5, volatiles 2.0%), #1000 (pH 3.5, volatiles 3.0%), #2200 (pH 3.5, volatiles 3.5%), MA230 (pH 3.0, volatiles 1.5%), MA220 (pH 3.0, volatiles 1.0%), #2650 (pH 3.0, volatiles 8.0%), MA7 (pH 3.0, volatiles 3.0%), MA8 (pH 3.0, volatiles 3.0%), OIL7B (pH 3.0, volatiles 6.0%), MA77 (pH 2.5, volatiles 3.0%), #2350 (pH 2.5, volatiles 7.5%), #2700 (pH 2.5, volatiles 10.0%), and #2400 (pH 2.5, volatiles 9.0%); those of Degussa AG such as Printex 150T (pH 4.5, volatiles 10.0%), Special Black 350 (pH 3.5, volatiles 2.2%), Special Black 100 (pH 3.3, volatiles 2.2%), Special Black 250 (pH 3.1, volatiles 2.0%), Special Black 5 (pH 3.0, volatiles 15.0%), Special Black 4 (pH 3.0, volatiles 14.0%), Special Black 4A (pH 3.0, volatiles 14.0%), Special Black 550 (pH 2.8, volatiles 2.5%), Special Black 6 (pH 2.5, volatiles 18.0%), Color Black FW200 (pH 2.5, volatiles 20.0%), Color Black FW2 (pH 2.5, volatiles 16.5%), Color Black FW2V (pH 2.5, volatiles 16.5%); and products of Cabot Corp. such as Monarch 1000 (pH 2.5, volatiles 9.5%), Monarch 1300 (pH 2.5, volatiles 9.5%), Monarch 1400 (pH 2.5, volatiles 9.0%), Mogul-L (pH 2.5, volatiles 5.0%), and Regal 400R (pH 4.0, volatiles 3.5%).

Such carbon black obtained by oxidation processing is less susceptible to the influence of oxidation, which is caused by locally excessive current under repeated voltage applications. Also the oxygen-containing functional group present on the surface increases the dispersibility in the polyimide resin, reducing fluctuations in resistance, and dependence on the electric field, thereby decreasing the chance of electric field concentration by the transfer voltage.

As a result, there can be obtained an intermediate transfer member capable of preventing a resistance decrease caused by the transfer voltage, improving the uniformity of electrical resistance, showing a reduced dependence on the electric field, also showing reduced change in the resistance due to the environment, and providing a high image quality, with reduced image defects such white skipped areas in portions of a job run. In the case where at least two kinds of the oxidation-processed carbon black are included, such oxidation-processed carbon blacks are preferably substantially different in electroconductivity, and different in physical properties such as a level of oxidation process, DBP oil absorption or BET specific surface area based on nitrogen adsorption.

In the case of adding two or more carbon blacks different in physical properties, it is possible, for example, to at first add a carbon black providing a high conductivity and then to add a carbon black providing a low conductivity, thereby regulating the surface resistivity or the like.

Specific examples of the oxidation-processed carbon black include Special Black 4 (manufactured by Degussa AG, pH 3.0, volatiles 14.0%) and Special Black 250 (manufactured by Degussa AG, pH 3.1, volatiles 2.0%). A content of such oxidation-processed carbon black is preferably 10 to 50 weight %, more preferably 12 to 30 weight % with respect to the polyimide resin. A content less than 10 weight % may deteriorate the uniformity of the electrical resistance, thereby resulting in a large loss in the surface resistivity with long-term use, while, at a content exceeding 50 weight %, a desired resistance may be difficult to obtain and a molded product may become undesirably brittle.

An intermediate transfer member of a polyimide resin in which an oxidation-processed carbon black is dispersed can be obtained by a step of preparing a polyamidic acid solution in which an oxidation-processed carbon black is dispersed, a step of forming a film (layer) on an internal peripheryl of a cylindrical mold, and a step of imidation.

For producing a polyamidic acid solution in which two or more types of the oxidation-processed carbon black are dispersed, there is conceived a method of dissolving and polymerizing the acid dianhydride component and the diamine component, in a dispersion liquid in which two or more types of the oxidation-processed carbon black are dispersed in advance in a solvent, and a method of dispersing two or more types of the oxidation-processed carbon black respectively in solvents thereby preparing two or more carbon black dispersion liquids, then dissolving and polymerizing the acid dianhydride component and the diamine component in each dispersion liquid, and mixing the polyamidic acid solutions, and such methods are suitably selected to obtain a polyamidic acid solution in which carbon black is dispersed.

The polyamidic acid solution thus obtained is supplied and developed on an internal periphery of a cylindrical mold to form a film, which is then heated to execute an imidation of the polyamidic acid. In such an imidation heating step, an intermediate transfer member with satisfactory surface flatness can be obtained by executing an imidation under a heating condition of maintaining a constant temperature for 0.5 hours or longer. In the following, this process will be explained in detail.

At first a polyamidic acid solution is supplied onto an internal periphery of a cylindrical mold. Such supplying method can be suitable selected such as a supply by a dispenser or by a die. The surface of the internal periphery of the cylindrical mold employed in this step is preferably mirror-finished.

Then thus supplied polyamidic acid solution is formed into a film of a uniform thickness, for example by a centrifugal molding method under heating, a molding method with a bullet-like runner, or a rotation molding method. Subsequently there can be executed a process of heating the mold bearing the film on the internal periphery thereof in a dryer to a temperature causing imidation, or a process of eliminating the solvent until the film can sustain a belt shape, then peeling the film from the internal periphery of the mold and placing the film on an external periphery of a metal cylinder, and heating the film together with the metal cylinder thereby achieving imidation. In order to obtain an intermediate transfer member satisfactory in the flatness and the precision of the external surface, a method of eliminating the solvent until the film can sustain a belt shape, then replacing the film on an external periphery of the metal cylinder, and executing imidation, is preferable.

A heating condition in the solvent eliminating step is not particularly restricted as long as the solvent can be eliminated, but is preferably 0.5 to 5 hours at 80 to 200° C. Then a molded substance, which can now sustain the form as a belt, is peeled off from the internal periphery of the mold. In this operation, a releasing treatment may be applied to the internal periphery of the mold.

Then the molded substance, which is heated and cured until it can sustain the form of a belt, is re-fitted on an external periphery of a metal cylinder and is heated together with such a metal cylinder, thereby causing an imidation reaction of the polyamidic acid.

The metal cylinder to be employed in this step preferably has a linear expansion coefficient larger than that of polyimide resin and is given an external diameter somewhat smaller than the internal diameter of the polyimide molded substance, thereby achieving thermal setting and obtaining a uniform endless belt of a uniform thickness. The metal cylinder to be employed in this step preferably has a surface roughness (Ra) on the external surface of 1.2 to 2.0 μm. In case the metal cylinder has a surface roughness (Ra) less than 1.2 μm on the external surface, the obtained belt-shaped intermediate transfer member may not cause slippage by shrinkage in the axial direction of the metal cylinder, because the metal cylinder itself is excessively flat, whereby drawing may occur resulting in fluctuations in the film thickness and a deteriorated precision of the flatness.

On the other hand, in case the metal cylinder has a surface roughness (Ra) exceeding 2.0 μm on the external surface, the external surface pattern of the metal cylinder may be transferred onto the internal surface of the belt-shaped intermediate transfer member and may generate irregularities on the external surface thereof, thus inducing image defects. A belt-shaped intermediate transfer member thus prepared of polyimide resin in which carbon black is dispersed has a surface roughness (Ra) of 1.5 μm or less on the external surface.

The surface roughness is measured according to JIS B601, the disclosure of which is incorporated by reference herein. A surface roughness (Ra) of the intermediate transfer member exceeding 1.5 μm may induce an image defects such as mottled images. This is presumably because an electric field, caused by the voltage applied at the transfer step or by a peeling charging, is locally concentrated on protruding portions of the belt, modifying the surface of such portions, thereby generating a new conductive path with a lower resistance and inducing a lower image density, thus giving a mottled impression on the entire image.

The heating step for imidation is conducted preferably with a heating temperature of 220 to 280° C. and a heating time of 0.5 to 2 hours. The shrinkage at imidation becomes largest with heating conditions of such a range, though it is dependent also on the composition of the polyimide resin, thereby achieving a gradual shrinkage of the belt in the axial direction thereof, thus avoiding fluctuations of the film thickness and the deterioration in the precision of flatness.

The intermediate transfer member after such a heating step has a flatness of 5 mm or less, preferably 3 mm or less. A flatness of 5 mm or less causes no mottling and little slippage among the colors. However, in case an edge portion of the belt is curled upward or downward, the belt with a flatness of 5 mm or less may occasionally leave a trace of contact with components in the vicinity, though such a belt does not show breakage in the course of use. An intermediate transfer member with a flatness of 3 mm or less does not cause contact with the components in the vicinity and scarcely shows slippage in the colors.

(Process Cartridge)

In the following there will be explained a process cartridge incorporating an electrophotographic photoreceptor of the invention.

Figure 5:
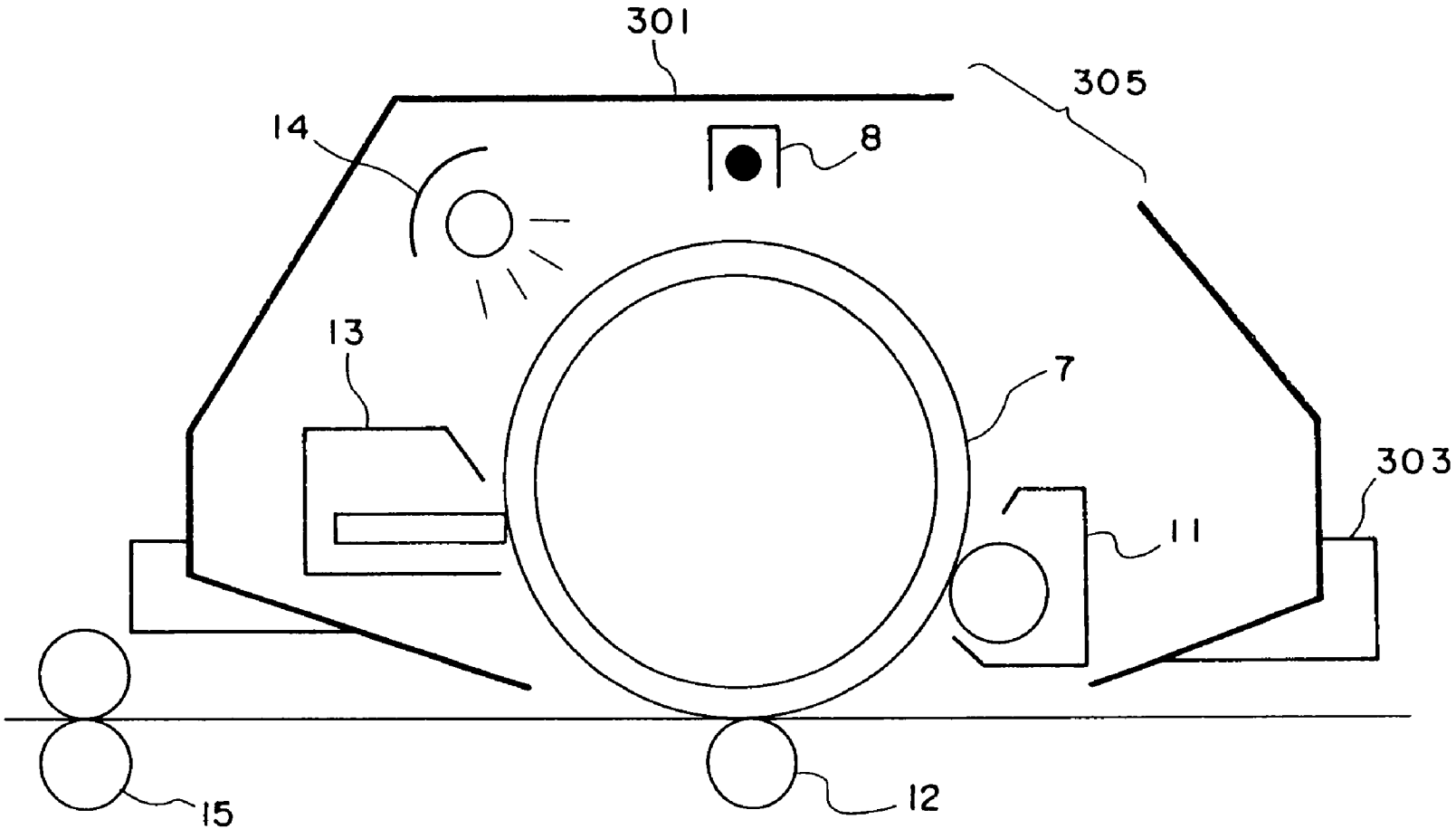
FIG. 5 is a schematic view illustrating one preferred embodiment of a process cartridge of the invention.

FIG. 5 is a schematic view showing a preferred embodiment of the process cartridge of the invention.

A process cartridge 300 incorporates, within a case 301, an electrophotographic photoreceptor 7, a charging apparatus 8, a developing apparatus 11, a cleaning apparatus 13 and a charge eliminator 14 which are combined and integrated with a rail 303. The process cartridge 300 is not equipped with an exposure apparatus, but has an aperture 305 for exposure in the case 301.

Further, the electrophotographic photoreceptor 7 is the above-mentioned electrophotographic photoreceptor of the invention, which is an electrophotographic photoreceptor 7 which comprises on an electroconductive substrate, an interlayer and a photosensitive layer comprising a charge-generating layer and a charge-transporting layer on the substrate, wherein the interlayer comprises fine metal oxide particles and the interlayer and the charge-generating layer comprise an anthraquinone derivative.

Such a process cartridge 300 is detachably mounted on a main body of an electrophotographic apparatus including a transfer apparatus 12, a fixing apparatus 15 and unillustrated other components, and constitutes an electrophotographic apparatus together with such a main body.

EXAMPLES

Hereinbelow, the present invention is described in more detail by means of the following Examples, but these examples are not intended to limit the invention.

Example 1

15 parts by weight of a polyvinylbutyral resin (S-Lec BM-S, manufactured by Sekisui Chemical Co., Ltd.) and 20 parts by weight of a hardening agent (BL3475, manufactured by Sumitomo Bayer Urethane Co., Ltd.) are dissolved in 80 parts by mass of 2-butanone, to which are added 90 parts by mass of zinc oxide powders (SMZ-017N10, manufactured by Tayca Corp.) and 3 parts by mass of 1-hydroxyanthraquinon, and the mixture is stirred. Using a Dyno-Mill dispersion device (manufactured by Shinmaru Enterprise Co.), the mixture is dispersion treated for 4 hours. To the obtained solution is added fine silicone particles (R935: average particle diameter 5.0 μm, manufactured by Toray Fine Chemicals Co., Ltd.) until a 5% solution, by volume based on all solid content of the solution, is obtained as a coating solution for the interlayer.

Then, a mixture consisting of 3 parts by mass of hydroxygallium phthalocyanine, which when examined by X-ray diffractometry with a CuK α ray, gives a diffraction spectrum having diffraction peaks at Bragg angles (2θ±0.2°) of 7.5°, 9.9°, 12.5°, 16.3°, 18.6°, 25.1° and 28.1°, 2 parts by mass of a vinyl chloride/vinyl acetate copolymer (VMCH, manufactured by Nippon Unicar Co., Ltd.), and 180 parts by mass of butyl acetate is subjected to dispersion treatment using a sand mill for 2 hours. Further, 0.05 parts by mass of 1,2-diaminoanthraquinone is added to obtain a coating solution for a charge-generating layer.

Further, as a charge-transporting material, 4 parts by weight of N,N'-bis(3,4-dimethylphenyl)biphenyl-4-amine and 6 parts by weight of a bisphenol Z-type polycarbonate resin (manufactured by Mitsubishi Chemical Corp.: Yupilon Z400), 0.2 parts by weight of 2,6-di-t-butyl-4-methylphenol are added and dissolved in 60 parts by weight of a mixed solvent of tetrahydrofuran (THF) and toluene to obtain a coating solution for a charge-transporting layer.

ED pipe aluminum (30 mmϕ) is used for the electroconductive support. An interlayer coating solution is dip coated on the aluminum support in a film thickness of 30 μm.

Further, the interlayer is formed by drying at 150° C. for 60 minutes.

Subsequently, the charge-generating layer coating solution is dip coated on the interlayer with the film thickness of 0.2 μm to form a charge-generating layer.

Then, the charge-transporting layer coating solution is coated on the charge-generating layer, and is dried at 120° C. for 40 minutes to form a charge-transporting layer with a film thickness of 20 μm.

Thereby, an electrophotographic photoreceptor comprising 3 layers is obtained.

Example 2

An electrophotographic photoreceptor is obtained in the similar manner as in Example 1 except that an anthraquinone derivative to be added to the charge-generating layer is the same compound (1-hydroxyanthraquinone) as in the interlayer.

Example 3

An electrophotographic photoreceptor is obtained in the similar manner as in Example 1 except that a compound to be added to the interlayer is alizarin, and a compound to be added to the charge-generating layer is 1-hydroxyanthraquinone.

Example 4

An electrophotographic photoreceptor is obtained in the similar manner as in Example 1 except that a compound to be added to the interlayer and the charge-generating layer is alizarin.

Comparative Example 1

An electrophotographic photoreceptor is obtained in the similar manner as in Example 1 except that 3 parts by weight of the below-described pyrazine-based compound is added only to the interlayer without adding the anthraquinone-based compound to the interlayer or the charge-generating layer. In addition, the below-described pyrazine-based compound possesses electron acceptor properties in the similar manner as in the anthraquinone derivative.

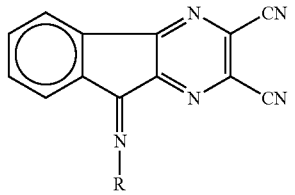

(R: Phenyl Group)

Comparative Example 2

An electrophotographic photoreceptor is obtained in the similar manner as in Example 1 except that 0.05 parts by weight of the above-described pyrazine-based compound is added only to the charge-generating layer without adding the anthraquinone-based compound to the interlayer and the charge-generating layer.

Comparative Example 3

An electrophotographic photoreceptor is obtained in the similar manner as in Example 1 except that 3 parts by weight of the above-described pyrazine-based compound is added to the interlayer and 0.05 parts by weight of the pyrazine-based compound is added to the charge-generating layer without adding the anthraquinone-based compound to the interlayer and the charge-generating layer.

Comparative Example 4

An electrophotographic photoreceptor is obtained in the similar manner as in Example 1 except that alizarin is added only to the charge-generating layer, not to the inter layer.

Comparative Example 5

An electrophotographic photoreceptor is obtained in the similar manner as in Example 1 except that the dispersion time of a coating fluid to the interlayer is set as 30 minutes.

Comparative Example 6

An electrophotographic photoreceptor is obtained in the similar manner as in Example 1 except that the dispersion time of a coating fluid to the interlayer is set as 20 hours.

Comparative Example 7

An electrophotographic photoreceptor is obtained in the similar manner as in Example 1 except that an anthraquinone derivative is not added to the interlayer and the charge-generating layer.

(Measurement of Surface Potential of Electrophotographic Photoreceptor)

Electrophotographic photoreceptors of the Examples and Comparative Examples are mounted on a modified full-color printer DocuCenter Color 400CP (contact charging method, tandem method), manufactured by Fuji Xerox Co., Ltd, and the surface potentials of the photoreceptor after charging and exposure are measured in the machine. The modified DocuCenterColor400CP is modified so that measuring of the surface potential of the photoreceptor in the machine can be carried out.

In addition, a continuous printing test is conducted at an image density of 5%, in which 50000 sheets of paper are printed, and the potential after the continuous printing is measured.

(Measurement of Volume Resistivity of Interlayer)

A coating solution for the interlayer is dip coated on an aluminum substrate, and is dried and hardened at 150° C. for 60 minutes to form an interlayer (film thickness: 30 μm).

To the interlayer, an electric field of $10^6$ V/m is applied thereto using a ϕ1-mm gold electrode as a counter electrode to measure the current values after 10 seconds and to determine a resistance of the interlayer at that time.

The resistance value is divided by the volume of the interlayer in the measured portion (≅electrode area ($\pi r^2$)×film thickness (30 μm)) to calculate the volume resistivity of the invention. The measurement is conducted at 28° C. and 85% RH humidity.

The obtained results are shown in Table 11.

CONCLUSIONS

Examples 1 to 4 of the invention, as compared to the Comparative Examples, can reduce the surface potential by elevating sensitivity of the photoreceptor. Further, by adding an anthraquinone derivative to both layers, the increase in the residual potential even after the job run can be inhibited.

Meanwhile, when a pyrazine-based compound is added to the interlayer as described in Comparative Example 1, the charge-generating layer as described in Comparative Example 2 and both layers as described in Comparative Example 3, the surface potential of the photoreceptor is high, and an increase in the potential due to the residual potentials is observed after the running.

In Comparative Example 6, wherein the volume resistivity of the interlayer is higher than the range disclosed in the invention, the effect of reducing the potential is not confirmed. Further, in Comparative Example 5, wherein the volume resistivity was lower than the range disclosed in the present invention, the effect of reducing the potential is observed, but image irregularities (fogging) occurs.

What is claimed is:

1. A multilayer electrophotographic photoreceptor comprising:

an electroconductive substrate, and at least an interlayer and a charge-generating layer formed on the substrate, wherein the interlayer comprises a binder resin containing at least one of alizarin and an alizarin derivative, in which fine metal oxide particles are dispersed, and that has a volume resistivity in a range of $1.0\times10^8$ Ω·cm to $1.0\times10^{13}$ Ω·cm when an electric field of $10^6$ V/m is applied thereto at 28° C. and 85% relative humidity; and wherein the charge-generating layer comprises an anthraquinone derivative wherein the anthraquinone derivative contained in the charge-generating layer is the same as the alizarin or alizarin derivative contained in the interlayer.

2. The electrophotographic photoreceptor according to claim 1, wherein the interlayer contains 0.1 to 3.0% by weight of the alizarin or alizarin derivative.

3. The electrophotographic photoreceptor according to claim 1, wherein the fine metal oxide particles are at least one

TABLE 11

| | Interlayer additive | Charge-generating layer additive | Volume resistivity (Ω · cm) | Initial surface potential (V) | Surface potential after running (V) |
|---|---|---|---|---|---|
| Ex. 1 | (A-2) | (B-5) | $5.7 \times 10^{10}$ | 70 | 245 |
| Ex. 2 | (A-2) | (B-2) | $5.4 \times 10^{10}$ | 67 | 241 |
| Ex. 3 | (A-7) | (B-2) | $5.4 \times 10^{10}$ | 63 | 245 |
| Ex. 4 | (A-7) | (B-7) | $5.5 \times 10^{10}$ | 57 | 230 |
| Comp. Ex. 1 | Pyrazine-based compound | — | $5.4 \times 10^{10}$ | 78 | 288 |
| Comp. Ex. 2 | — | Pyrazine-based compound | $5.6 \times 10^{10}$ | 80 | 285 |
| Comp. Ex. 3 | Pyrazine-based compound | Pyrazine-based compound | $5.4 \times 10^{10}$ | 77 | 280 |
| Comp. Ex. 4 | — | (B-7) | $5.8 \times 10^{10}$ | 78 | 286 |
| Comp. Ex. 5 | (A-2) | (B-2) | $8.8 \times 10^{7}$ | 70 | 235 |
| Comp. Ex. 6 | (A-2) | (B-2) | $1.2 \times 10^{13}$ | 92 | 388 |
| Comp. Ex. 7 | — | — | $5.6 \times 10^{10}$ | 85 | 324 |

Note:
In the comparative example 5, fogging occurs.

metal oxide selected from the group consisting of tin oxide, titanium oxide, zinc oxide and zirconium oxide.

4. The electrophotographic photoreceptor according to claim 3, wherein the fine metal oxide particles are fine zinc oxide particles.

5. The electrophotographic photoreceptor according to claim 1, wherein the fine metal oxide particles are ones which have been subject to a surface treatment with a silane coupling agent.

6. The electrophotographic photoreceptor according to claim 1, wherein the charge-generating layer contains 0.01 to 2.0% by weight of the anthraquinone derivative.

7. A process cartridge comprising:

an electrophotographic photoreceptor; and at least one of a charging unit, a development unit, a cleaning unit or a charge erasing unit, wherein the electrophotographic photoreceptor is a multilayer electrophotographic photoreceptor comprising an electroconductive substrate, and at least an interlayer and a charge-generating layer formed on the substrate;

wherein the interlayer comprises a binder resin containing at least one of alizarin and an alizarin derivative, in which fine metal oxide particles are dispersed, and that has a volume resistivity in a range of $1.0\times10^{8}$ Ω·cm to $1.0\times10^{13}$ Ω·cm when an electric field of $10^{6}$ V/m is applied thereto at 28° C. and 85% relative humidity; and wherein the charge-generating layer comprises an anthraquinone derivative;

wherein the anthraquinone derivative contained in the charge-generating layer is the same as the alizarin or alizarin derivative contained in the interlayer; and wherein the process cartridge can be attached to and removed from a main body of an electrophotographic apparatus.

8. The process cartridge according to claim 7, wherein the interlayer contains 0.1 to 3.0% by weight of the alizarin or alizarin derivative.

9. The process cartridge according to claim 7, wherein the fine metal oxide particles are at least one metal oxide selected from the group consisting of tin oxide, titanium oxide, zinc oxide and zirconium oxide.

10. The process cartridge according to claim 9, wherein the fine metal oxide particles are fine zinc oxide particles.

11. The process cartridge according to claim 7, wherein the fine metal oxide particles are ones which have been subjected to a surface treatment with a silane coupling agent.

12. The process cartridge according to claim 7, wherein the charging unit comprises a contact charging unit, which comes into contact with the electrophotographic photoreceptor and charges the photoreceptor.

13. An electrophotographic apparatus comprising:

an electrophotographic photoreceptor; and at least one of a charging unit, a development unit, a cleaning unit, a charge erasing unit, a transfer unit or a fixing unit;

wherein the electrophotographic photoreceptor is a multilayer electrophotographic photoreceptor comprising an electroconductive substrate, and at least an interlayer and a charge-generating layer formed on the substrate;

wherein the interlayer comprises a binder resin containing at least one of alizarin and an alizarin derivative, in which fine metal oxide particles are dispersed, and that has a volume resistivity in a range of $1.0\times10^{8}$ Ω·cm to $1.0\times10^{13}$ Ω·cm when an electric field of $10^{6}$ V/m is applied thereto at 28° C. and 85% relative humidity; and wherein the charge-generating layer comprises an anthraquinone derivative;

wherein the anthraquinone derivative contained in the charge-generating layer is the same as the alizarin or alizarin derivative contained in the interlayer.

14. The electrophotographic apparatus according to claim 13, wherein the charging unit comprises a contact charging unit, which comes into contact with the electrophotographic photoreceptor and charges the photoreceptor.

* * * * *